US007010816B2

(12) United States Patent
Li

(10) Patent No.: US 7,010,816 B2
(45) Date of Patent: Mar. 14, 2006

(54) PRESSURE ASSISTED DUAL FLUSH OPERATING SYSTEM

(76) Inventor: Feiyu Li, First Floor, #43, Huli Main Road, Xiamen (CN) 361006

( * ) Notice: Subject to any disclaimer, the term of this patent is extended or adjusted under 35 U.S.C. 154(b) by 255 days.

(21) Appl. No.: 10/719,931

(22) Filed: Nov. 20, 2003

(65) Prior Publication Data

US 2004/0194200 A1 Oct. 7, 2004

Related U.S. Application Data

(60) Provisional application No. 60/460,550, filed on Apr. 4, 2003.

(51) Int. Cl.
*E03D 3/10* (2006.01)

(52) U.S. Cl. ..... 4/354

(58) Field of Classification Search ..... 4/354, 4/359–362

See application file for complete search history.

(56) References Cited

U.S. PATENT DOCUMENTS 3,605,125 A 9/1971 Gibbs et al.
3,817,489 A 6/1974 Caron et al.
3,820,754 A 6/1974 Caron et al.
4,233,698 A 11/1980 Martin
5,046,201 A 9/1991 Steinhardt et al.
5,802,628 A * 9/1998 Spoeth et al. ..... 4/359
5,970,527 A * 10/1999 Martin et al. ..... 4/361
6,029,287 A 2/2000 Ge et al.
RE37,921 E 12/2002 Martin et al.
6,550,076 B1 * 4/2003 Fish ..... 4/359
2004/0128753 A1 * 7/2004 Gubeli et al. ..... 4/354

* cited by examiner

*Primary Examiner*—Charles E. Phillips
(74) *Attorney, Agent, or Firm*—Walter A. Hackler

(57) ABSTRACT

A pressure assisted dual flush operating system includes a vessel for receiving, containing and discharging pressurized water and an outlet for discharge of water from said vessel. An anti-siphon valve includes an air inlet for introducing water into said vessel and an inlet valve is provided for admitting water to the anti-siphon valve. A dual flush valve selectively releases different quantities of water from said vessel through the vessel outlet and a control valve selects one of the different quantities of water released by the dual flush valve.

10 Claims, 17 Drawing Sheets

PRESSURE ASSISTED DUAL FLUSH OPERATING SYSTEM

This application claims priority from provisional application 60/460,550 filed Apr. 4, 2003.

FIELD OF THE INVENTION

The invention relates to a toilet flush system, more particularly a pressurized dual flush system.

BACKGROUND OF THE INVENTION

A conventional pressure flush system uses a pressure water vessel disposed inside a toilet water tank. When water is infused into the vessel, the air in the water vessel is compressed and pressure accumulates inside the vessel. When a flush is needed, a user discharges the pressurized water through a discharge valve and through a toilet bowl trapway in order to provide a flushing action.

Thus, a pressure flush system utilizes compressed air to drive water into the bowl instead of the "pulling" or siphon action of gravity style toilets. As the result, a little amount of water provides a full and effective flushing of the pressure flush toilet.

The typical structure of a prior art pressure flush system is described in patent to Martin, 1977 (No.4233698), which primarily includes the pressure water vessel, flush valve, control valve refill valve, and air induction valve used to add pressure to the flush valve. In such a system, however, there are some problems as follows:

1. The flush valve of the system has only one single flush function. That is to say that once the control valve opens the flush valve, all volume of water in the water vessel will be flush out. Under this method the adjustment of discharge volume is not allowed.
2. There is only one secure device taken in the air induction valve. Since the water vessel is sealed, pressure must be contained. Any excess pressure over the strictly preset limitation may be dangerous. Therefore, there is potential safety concern if there was only one discharge protector used.
3. The refill rate is not adjustable. The refill volume may be too much or too little when the system is used with differently designed toilet bowls.
4. The flush valve cannot be shut off when a low pressure occurs in the water supply pipe, and this may cause water leaking from the pressure vessel.

Another prior art example is the reissued patent Martin et al., 2002 (NO.RE37921E7), which comprises a water vessel, an external manifold mounted directly on said vessel, and an internally mounted flush valve assembly. The manifold comprises a water pressure regulator, an air induction system, and a manually operable flush valve actuator. The manually operable flush valve actuator controls the discharge of water under pressure from the water vessel into the toilet bowl. Although some improvements were made in this invention, there are still some shortcomings as follows:

1. The system only has the single flush function also and the refill rate is not adjustable.
2. A complicated cleaning device is required. To make the piston of the flush valve drop slowly enough to make the pressure water let out from the vessel completely, the annular section of the inlet of the flush valves must be as small as about 0.00078 $inch^2$ or 0.5 $mm^2$). A small opening like this is very easy to be blocked by impurities in the water supply. Therefore, a cleaning device needs to be attached, which complicates the structure.

Other partial flush systems have been implemented, but have not been implemented with a pressurized flushing system. The term partial flush refers to quantities that are less than a full flush. The term partial flush is not limited to fifty percent water volume of a full flush.

OBJECTS AND ADVANTAGES

The object of the invention is to provide a pressure assisted dual flush system for providing two different water discharge volumes. Accordingly, the advantages of such invention are:

1. The present invention has dual flush function. The dual flush valve has two pistons. The top piston and bottom piston are set in the dual flush valve forming top chamber and bottom chamber. When partial tank flush is desired, for liquid waste for instance, the user needs only to discharge the pressurized water in the bottom chamber of the vessel by raising the bottom piston. In addition the user may discharge all the water in both the top and bottom chambers at the same time when a full tank flush is needed to discharge solid waste.
2. The present invention has a triple safety device, namely the stabilizing device in the refill valve and a double safety pressure relief device.
3. The control valve is also designed with dual flush function according to the dual flush valve and can be set independently from the system, to adapt with different assemble models.
4. The present invention has an excellent suitability and can be matched with all types of the toilet models. Because the control valve set is independent from the dual flush valve, the control valve can be set on any position of the ceramic water tank and can be easily matched with the front plate type, side plate type and the top plate type toilet tank.
5. The present invention has a self-lock piston, which stabilizes the total discharge water volume.
6. The suitability of the present invention can be seen from its adaptation to all kinds of toilet tanks with different water sealing requirements. The user can adjust the cross position between the through opening and the radial opening at the side wall of the bottom piston, to adjust the size of the sectional opening of the refill device. Thus, to adjust the refill volume to apply the present invention to various toilet bowl models.
7. The present invention has self-cleaning function. Since the inlet of the dual flush valve of present invention does not control the drop speed of the bottom piston, the diameter of the opening can be designed comparatively larger. In order to control the drop speed of the bottom piston, a guide slot is attached to the slide bar of the bottom piston. The radius of the guide slot is designed so as to control the descending speed of the bottom piston. During the actuation of the bottom piston, the fluid flows cleans the guide slot and is an additional feature of the invention.

SUMMARY OF THE INVENTION

A pressure assisted dual flush operating system in accordance with the present invention generally includes a vessel for receiving, containing and discharging pressurized water with the vessel having an outlet for discharge of water from the vessel.

An anti-siphon valve is provided which includes an airlet inlet for introducing water into the vessel and an inlet valve for admitting water to the anti-siphon valve.

A dual flush valve is provided for selectively releasing different quantities of water from the vessel through the vessel outlet and a control valve is provided for selecting one of the different quantities of water released by the dual flush valve.

Preferably, the vessel is sized for containment within a toilet tank and the control valve is disposed in fluid communication with the dual flush valve through flexible conduits in order to enable placement of the control valve anywhere on the toilet tank. This facilitates retrofitting the dual flush system in accordance with the present invention into existing toilets which have a toilet bowl equipped with a hydraulic jet. Thus, the control valve may be installed in a toilet tank through a front surface or a side surface as provided by the existing tank.

More specifically, the control valve includes a pivotable handle and two conduits interconnected with the dual flush valve along with a mechanism for hydraulically selecting one quantity of water to be released by the dual flush valve upon pivoting of the handle in one direction and hydraulically selecting another quantity of water to be released by the dual flush valve upon pivoting of the handle in an opposite direction. The selection of water to be released by pivoting of the handle may be reversed upon reversal of interconnection of the two conduits between the control valve and the dual flush valve.

Preferably, the dual flush valve is disposed within the vessel and the anti-siphon valve and the inlet valve are attached to the vessel.

The inlet valve and the siphon valve are in fluid communication with one another through a conduit disposed exterior to the vessel and a fluidic connection is provided between the control valve, the inlet valve, and the vessel outlet for directing overflow of water into the vessel outlet to reduce water accumulation in the toilet tank beneath the vessel. A gland may be provided for removing water from between the vessel and the toilet tank upon release of water through the vessel outlet.

DETAILED DESCRIPTION OF THE PREFERRED EMBODIMENT

Figure 1:
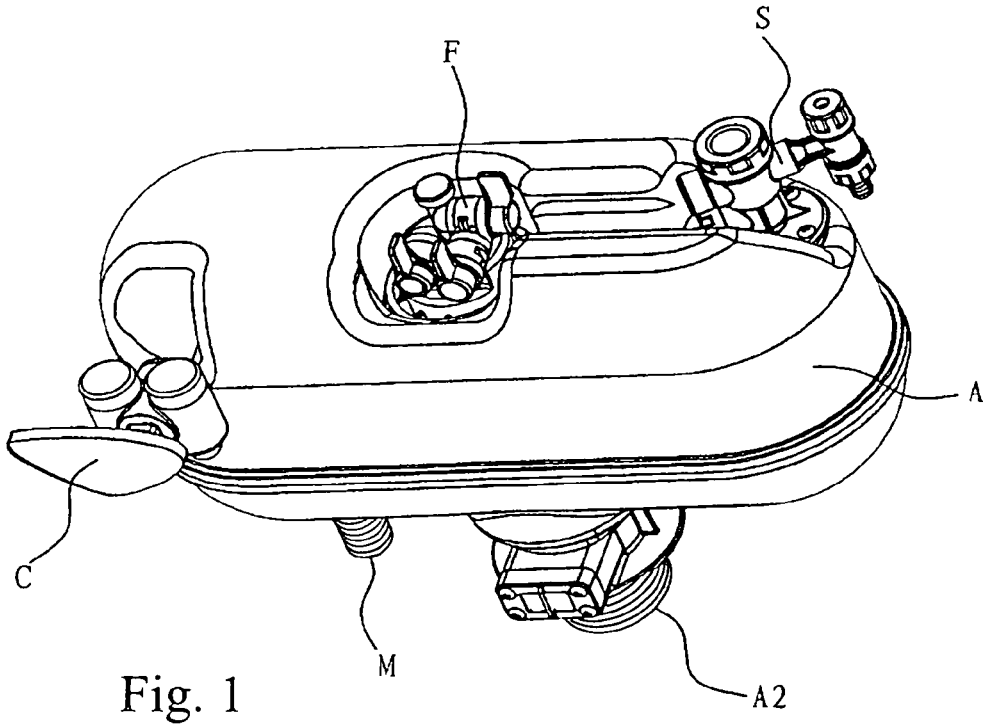
FIG. 1 is the outside view of the present invention, showing the whole device
Figure 2:
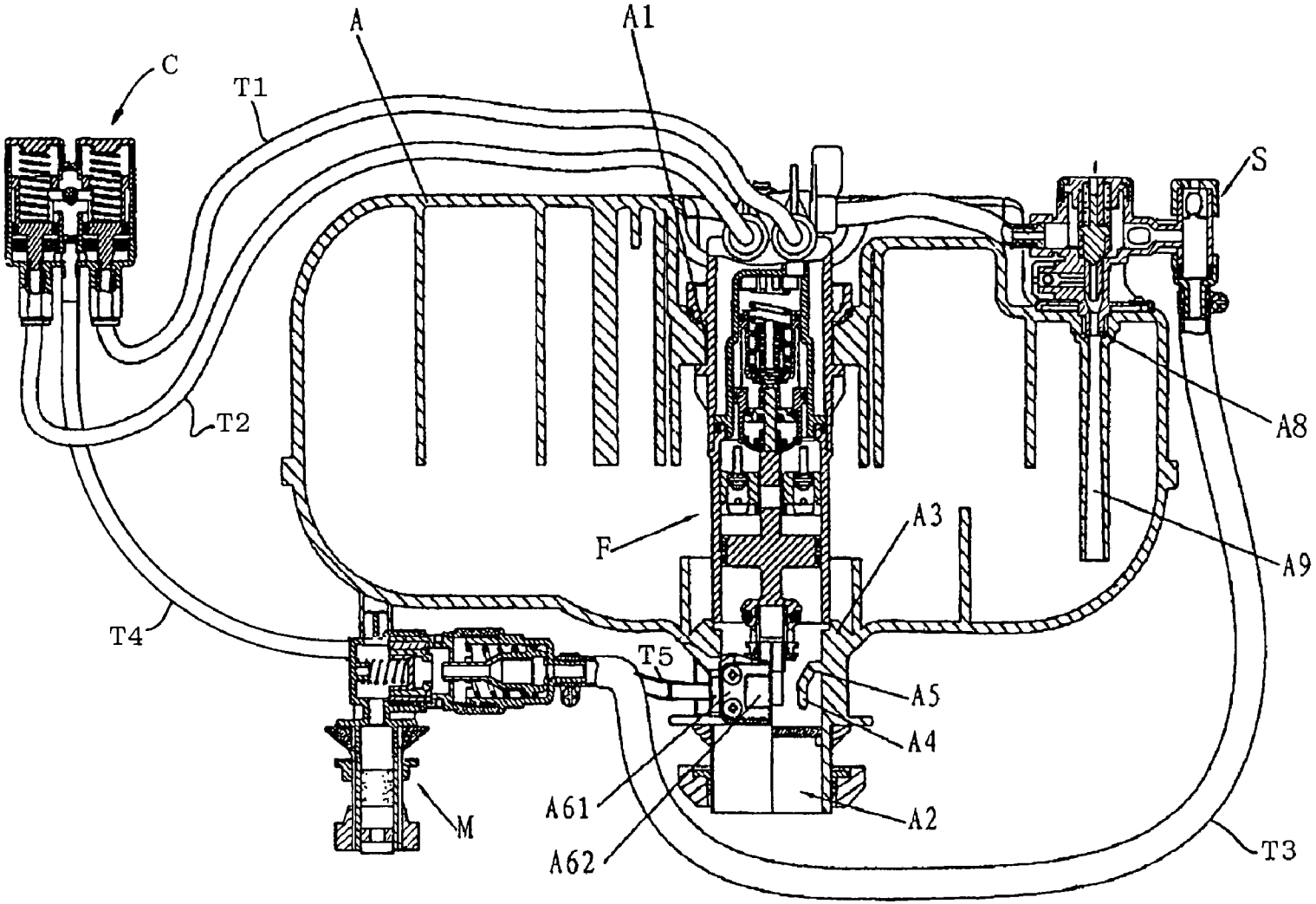
FIG. 2 is the sectional view of present invention (not showing the control valve)

As is shown in FIG. 1 and FIG. 2, the invention includes the pressure water vessel A, the infill valve M, the air-in valve S, the dual flush valve F and the dual flush control valve C. The infill valve M is fixed in the lower left of the pressure water vessel A. The air-in valve S is fixed in the upper right of the pressure water vessel A The dual flush valve F is fixed through the middle of the pressure water vessel A. The dual flush control valve C can be installed in any position of a toilet tank (not shown in the Figs.), namely the either front side, side or top of the toilet tank as hereinabove noted.

Figure 3:
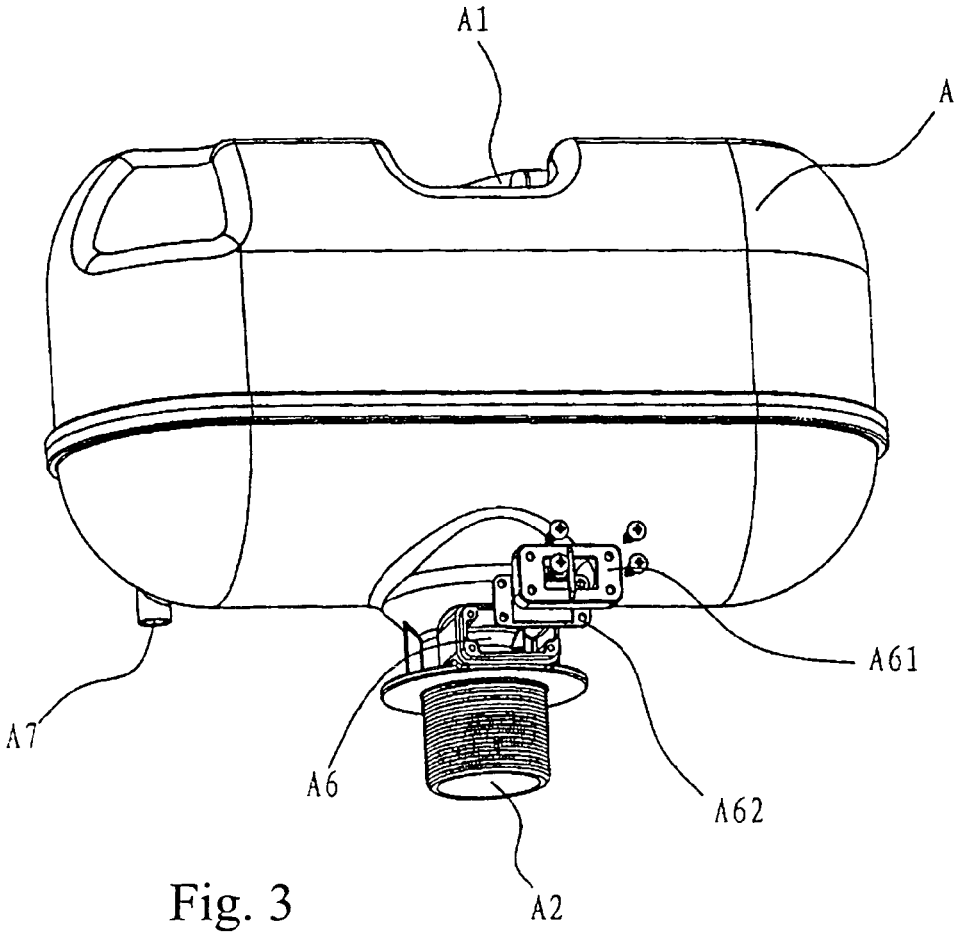
FIG. 3 is the stereoscopic diagrammatic sketch of the pressure water vessel

The Pressure Water Vessel A (Please Refer to the FIG. 1 to 3)

The pressure water vessel A is a sealed container made of high-strength and high-stability material. An opening A1 is set above the center of vessel A with some projections around its brim. The outlet A2 is set under the opening A1 and some external threads are set in the peripheral lower section of the outlet A2 to connect with the inlet of the toilet tank. A locating plate A3 is set at the top of the outlet A2. An outlet A4 is set under the locating plate A3 and inside the upper section of the outlet A2, and its inner diameter is smaller than the diameter of the outlet A2. Conic surface A5 is set above the outlet A4. In addition, the stabilizing outlet A6 is set at the side of the upper section of the outlet A2 responding to the outlet A4. The flush gland A61 and the flush baffle A62 are screwed with the stabilizing outlet A6. A cylinder locating hole A7 is set in the lower left of the pressure water vessel A. The inlet A8 is set in the upper right of the pressure water vessel A. The inlet A8 is installed through the tank A forming an air and water mixed duct A9 to improve intake effect.

The pressure water vessel A is installed inside the toilet tank and the water inlet of the toilet tank with the threaded portion of the outlet A2. The control valve C is in fluid communication with the dual flush valve F through flexible conduit T1, T2 to enable placement of the control valve C anywhere on the toilet tank, not shown. A flexible conduit T3 interconnects the air-in valve S with the influid valve M and conduit T4, T5 provide a fluidic connection between the control valve C, inlet valve M and outlet A2 for directing overflow water into the outlet A2 to reduce water accumulated in the toilet tank (not shown) and vessel A.

Figure 4:
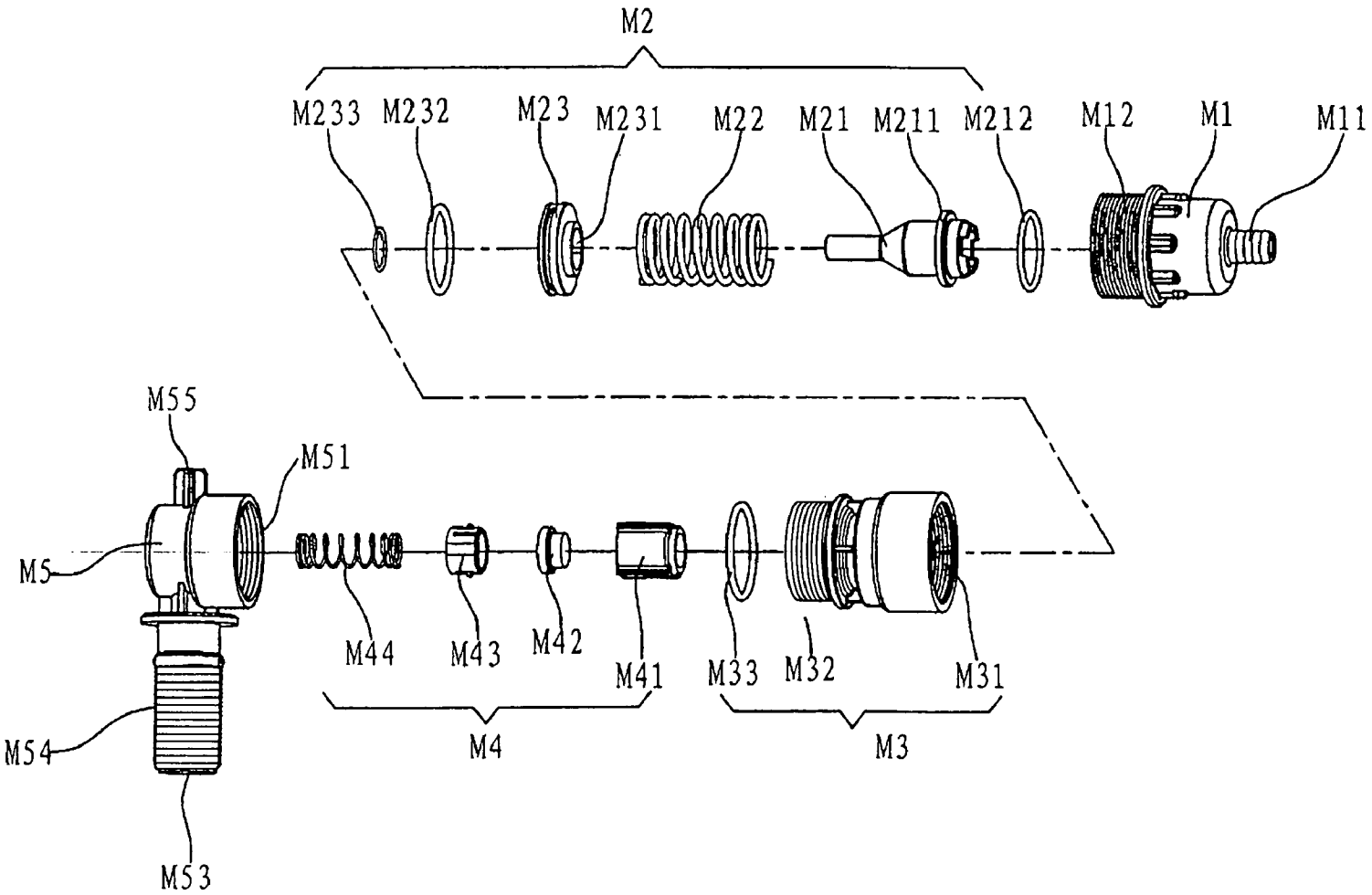
FIG. 4 is the stereoscopic decomposition diagram of the infill stabilizing valve
Figure 5:
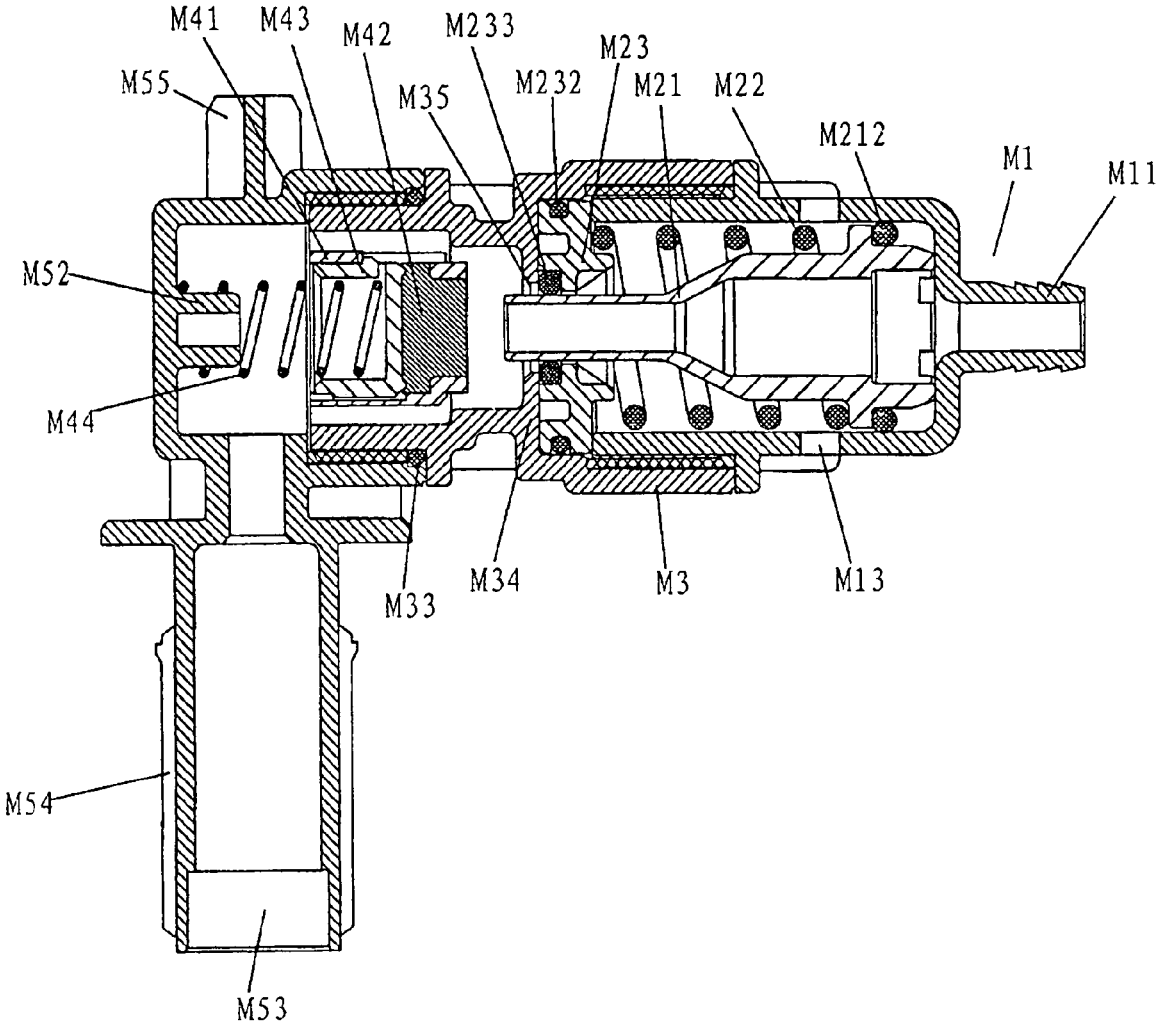
FIG. 5 is the sectional view of the infill stabilizing valve

The Infill Valve M (Please Refer to the FIGS. 4 and 5)

As is shown in the FIG. 4, the infill valve M includes front cover M1, valve handle parts M2, valve body M3, valve support M4 and rear cover M5.

The outlet M11 is set in front of the front cover M1, while external thread is set behind the front cover M1. Several out gates M13 are set around the middle section of the front cover M1. Valve handle parts M2 include valve handle M21, valve handle spring M22 and seal cover M23. Valve handle M21 is a hollow trumpet shaped having flange M211 in its front section where a seal component M212 is set in front of flange M211. Seal cover M23 is a disk at the center of which an opening M231 for receiving the posterior segment of the valve handle M21. A seal component M232 is set in a periphery of the seal cover M23 and a seal component M233 is set between the opening M231 and the valve handle M21.

The valve body M3 is a hollow cylinder with an internal thread M31 in the front portion and an external thread M32 in the rear portion. A seal component M33 is set in the rear portion of the tread M32, and a baffle M34 is set in between the front and rear portions. An opening M35 is set in the center in of the baffle M34.

The valve support M4 includes movable valve support M41, sealing plate M42, hold set M43 and valve support spring M44. The movable valve support M41 is a cylinder with a sealing plate M42 in it, and the sealing plate M42 is set in the movable valve support M41 by the holding set M43.

The rear cover M5 is an inverted L shaped hollow, with an internal thread M51 set at front. A fixing pole M52 is set inside the rear cover M5 fixing the valve support spring M44. An inlet M53 is set at the bottom of the rear cover with an external thread M54 around, and a cross guide pole M55 is set above the cover.

While assembling, please refer to FIG. 5, first slip the valve support spring M44 on the fixing pole M52 in the rear cover M5, then slip the sealing plate M42 and the holding set M43 in the valve support M4 in turn, and push them to the other end of the value support M44. Then connect the valve body M3 (with the seal component M33) with the rear cover M5 by screwing external thread M32 with internal thread M51.

Then place the seal cover M23 (with the seal components M232 and M233) into the front portion of the valve body M3, pushing it onto the baffle M34. Then set the handle M21 (with the valve handle spring M22) into the opening M231 of the seal cover M23. Finally, screw the front cover M1 onto the valve body M3 to complete the assembly.

After assembly, fix the infill valve M onto the toilet water tank with the external thread M54 at the bottom of the rear cover M5, connect it with the upper duct of the supply system, and set the cross guide pole M55 into a locating opening M7 at the bottom of the A, so that the valve M can be fix tight. Connect the outlet M11 of the front cover M1 with a hose and a hoop, then connect the hose with the infill duct S2 of the air-in valve S described later in the next paragraph.

Figure 6:
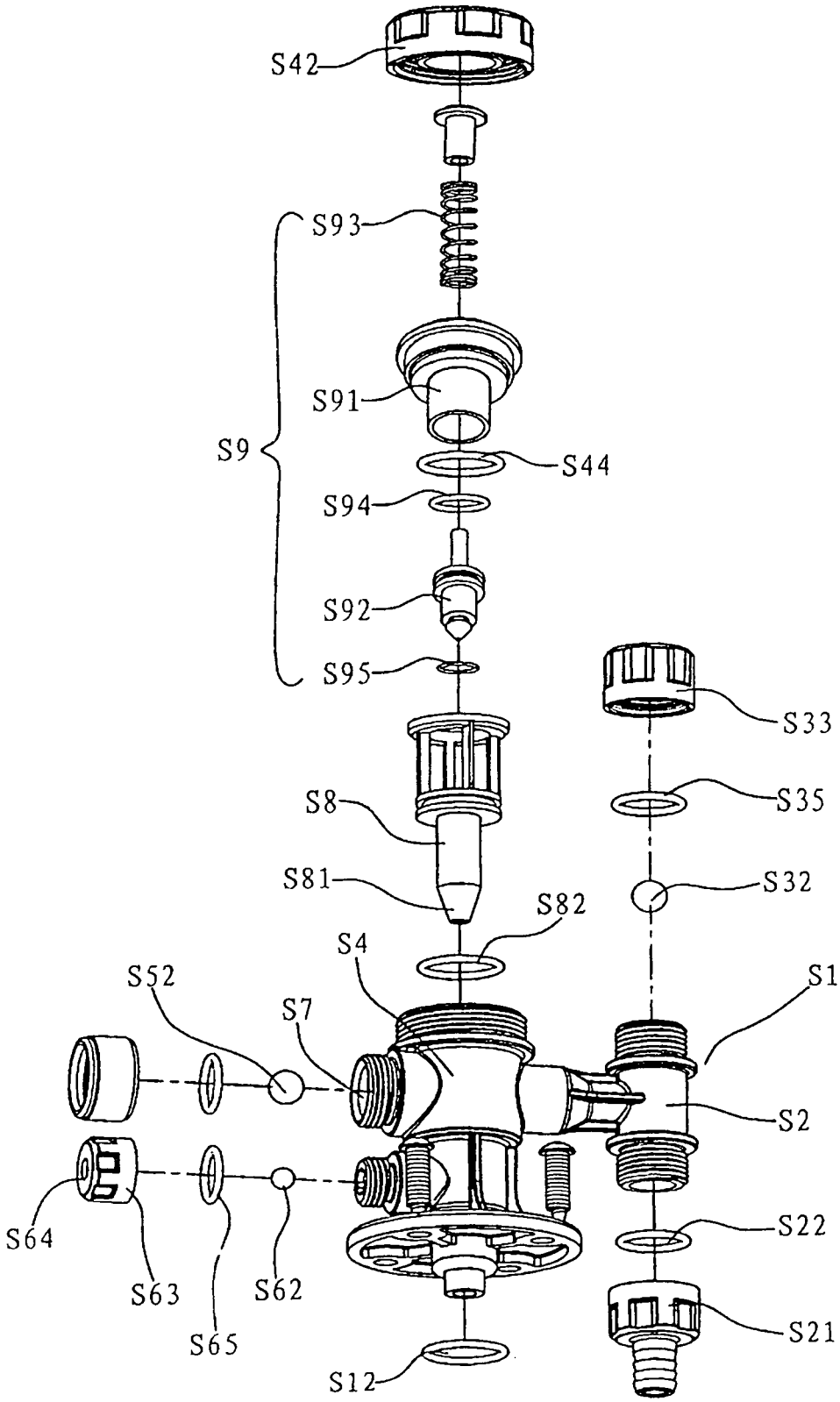
FIG. 6 is the stereoscopic decomposition diagram of the air-in valve
Figure 7:
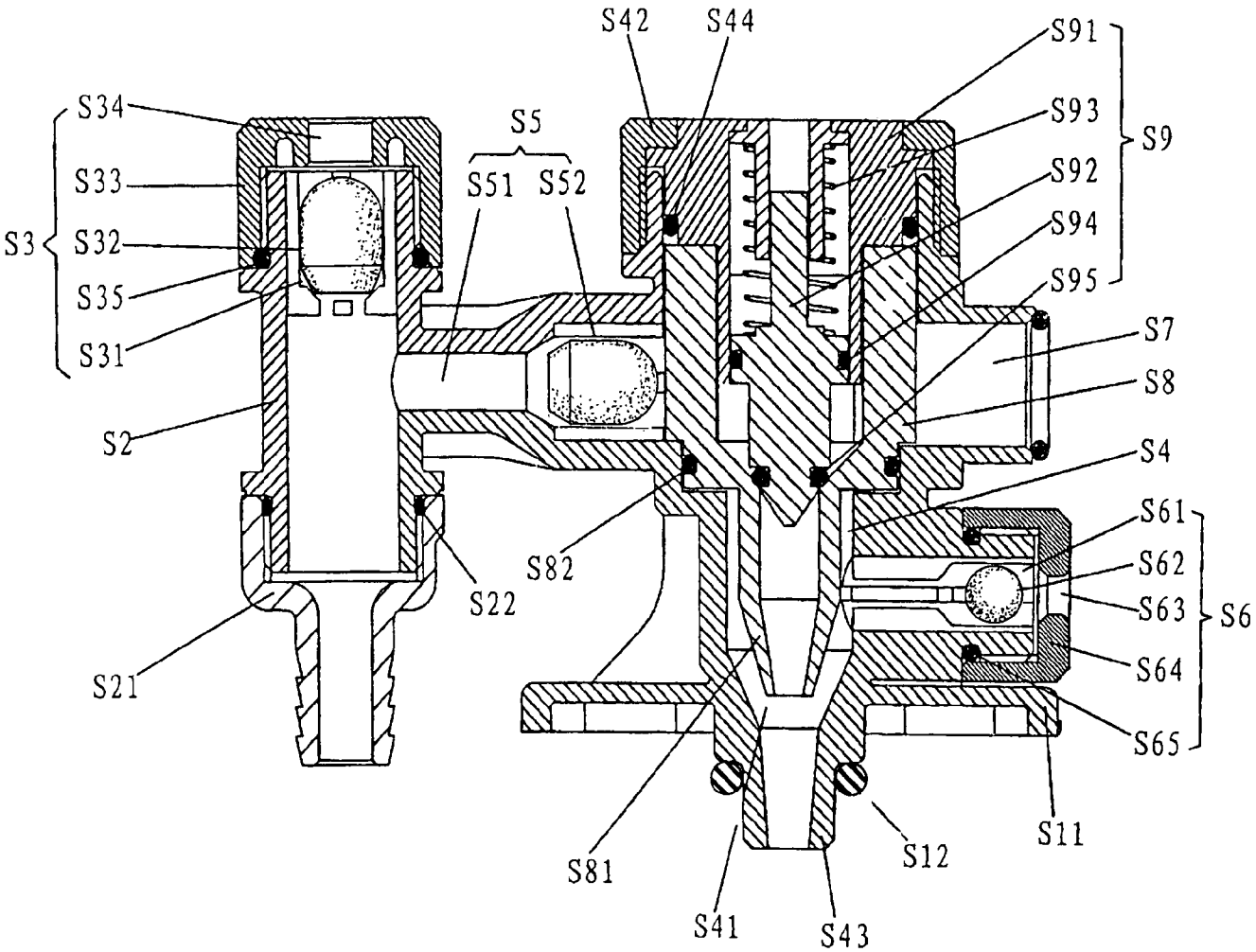
FIG. 7 is the sectional view of the air-in valve

The Air-in Valve S (Please Refer to the FIGS. 6 and 7)

As shown in FIG. 6, set in the body S1 of the air-in valve S there are infill duct S2, anti-siphon valve S3, discharge duct S4, check valve S5, air-in valve S6, outlet S7 supplying water to the dual flush valve F, and low pressure control valve S9.

The hose, or conduit, connection S21 is set under the inlet duct S2 with a seal component S22 between them.

The valve S3 is set on the duct S2, including the duct S31 connected with the duct S2, having a sealed siphon ball S32 fixed on the duct S31 and the S33 screwed on the duct S31. The air hole S34 is set in the cover S33 which diameter is smaller than the ball S32, and the seal components S35 is set in the junction between the cover S33 and the body S1.

The outlet S43 is set under the duct S4, and a fixed disk S11 is set on the bottom of the duct S4 in which an air spout S8 is set. A neck portion S81 is set under the spout S8 forming a ring chamber S41 in between the neck portion S81 and the inwall of the duct S4. A seal component S82 is set between the spout S8 and the duct S4. A valve cover S42 is fixed at the top of the duct S4, above the spout S8.

A control valve S9 is set between the cover S42 and the air spout S8, which includes valve support S91, filler plug S92 and spring S93. A seal component S44 is set between the support S91 and the duct S4. The filler A92 moves up and down inside the support S91 where a seal component S94 is set between them. A seal component S95 is set under the block S92 and the block S92 is fixed above the neck portion S81 inside the spout S8 while the seal component S95 is being pushed by the spring S93.

The check valve S5 is set between the infill duct S2 and the outlet duct S4 above the neck portion S81, which includes a sealed ball S52 and a channel S51 respectively connecting with the ducts S2 and S4. The channel S51 is echeloned upon the sealed ball S52. The diameter of the echeloned end connecting with the duct S2 is comparatively smaller then the other end.

The air-in valve S6 is set above the duct S4 and is located in the ring chamber S41. Similar to the valve S3, the air-in valve S6 also includes a channel S61 connecting with the duct S4, a sealed ball S62 limited in the channel S61, and a cover S63 fixed on the duct S61. An inlet S64 with smaller diameter than the ball S62 is set above the cover S63. A seal component S65 is set in the screwed junction of the cover S63 and the body S1. The valve S6 also provides for back flow protection to the inlet valve M in order to prevent contaminated water from being pulled back into the inlet valve and a water supply (not shown) connected thereto.

In addition, an outlet S7 is set in the outlet duct S4, behind the check valve S5 and in front of the spout S8. The outlet S7 is able to supply water to the dual flush valve F.

While assembling, referring to FIG. 7, firstly connect the hose with hose junction S21 under the duct S2, and then set the sealed ball S32 into the channel S31 while having the cover S33 screwed above it. Then set the seal ball S52 into the channel S51 through the outlet S7, and inset the spout S8 through the upper side of the duct S4. Then set control valve S9 above the spout S8, pushing the seal component S95, under the block S92, upon the upper portion of the neck portion S81, and screw on the cover S42. Finally set the sealed ball S62 into the channel S61, and screw on cover S63.

The fixed disk S11 of the valve S is screwed with the inlet of the vessel A, where the outlet S43 is matched with the inlet A8 of the vessel A with the seal component S12 in the junction. The hose junction S21 of the duct S2 is connected with the hose in the outlet M11 of the inlet valve M. The outlet S7 is connected with the inlet 13 of the dual flush valve F (described below) by a hose.

Figure 8:
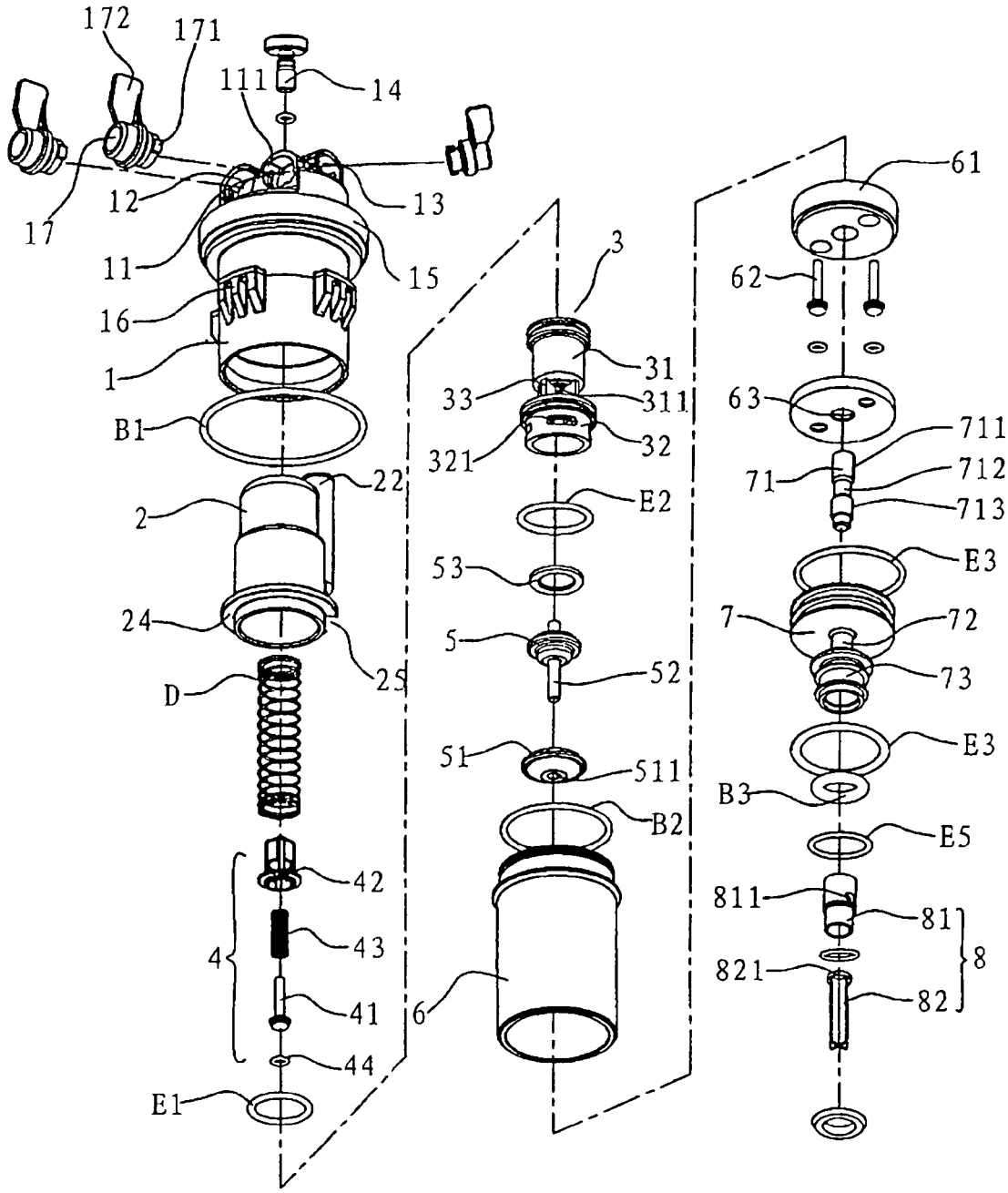
FIG. 8 is the stereoscopic decomposition diagram of the dual flush valve
Figure 9:
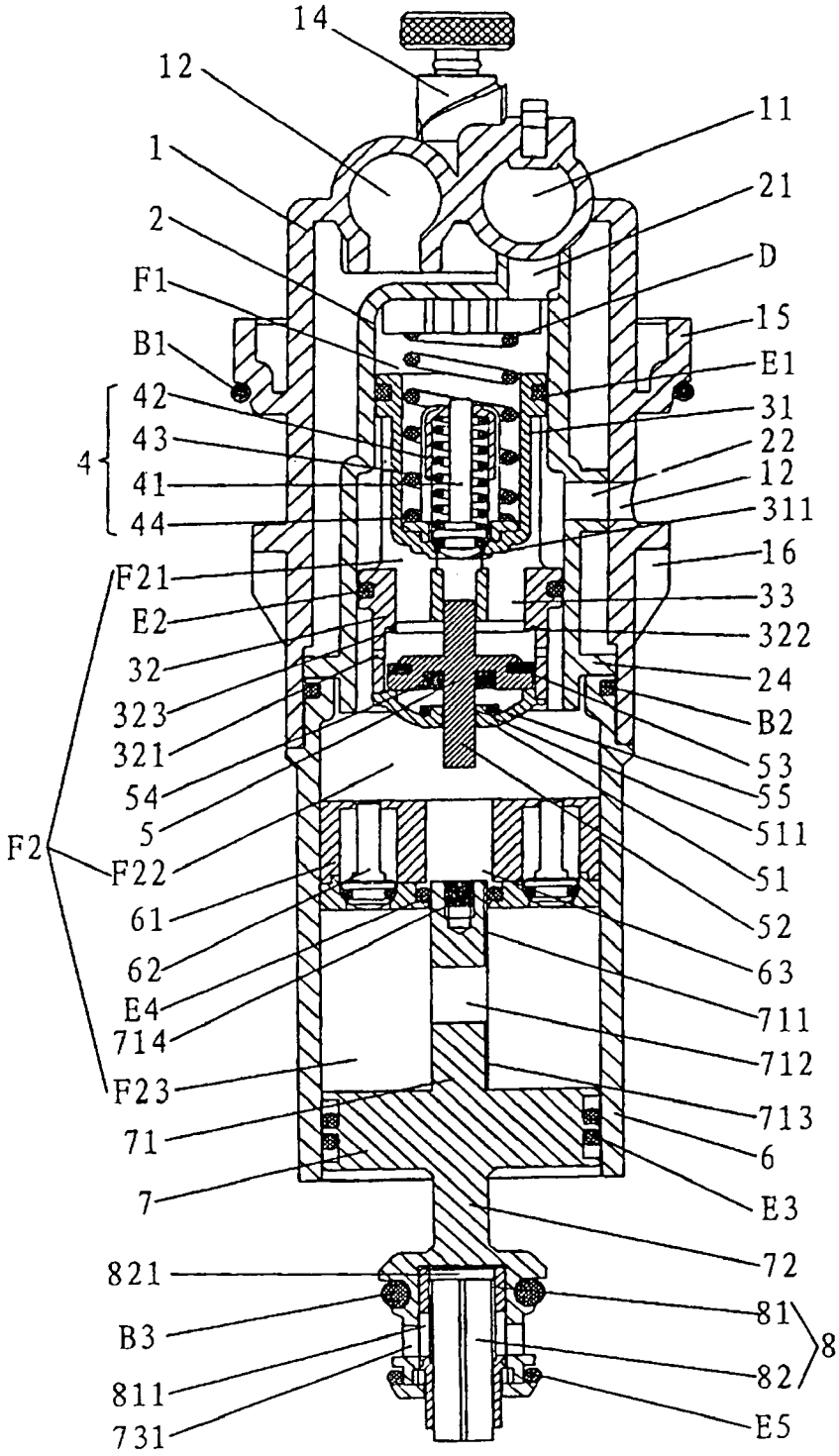
FIG. 9 is the sectional view of the dual flush valve

The Dual Flush Valve F (Please Refer to FIGS. 8 and 9)

As shown in FIG. 8, the dual flush valve F includes valve body 1, upper cylinder sleeve 2, upper piston 3, one-way valve 4, self-lock piston 5, lower cylinder sleeve 6, lower piston 7, and refill device 8.

A protrusion 15 with the seal component B1 and four adequate distribution sockets 16 is set around the valve body 1. There is some reserved space between the protrusion 15 and the sockets 16. The valve body 1 is hollow shaped above which a full flush outlet 11, a partial flush outlet 12 and an inlet 13 are set.

The full flush outlet 21 is set on top of the upper cylinder sleeve 2 connecting with the full flush outlet 11 of the valve body 1. A half outlet 22 is set in the middle of the upper cylinder sleeve 2 connecting with the half outlet 12 of the valve body 1. A ring locating protrusion 24 is set at the bottom of the sleeve 2, having a depression 25.

A cup body 31 is set on the top of the upper piston 3, where there is a seal components E1 around the top of the cup body and a through opening 311 is located at the bottom of it. A tubular body 32 is set at the bottom of the top piston 2 connecting to the cup body 31 by a connecting rib 33, where there is a seal components E2 around the top of the tubular body and a through opening 321 is located at the wall of the tubular body. In addition, an inner flange 322 is set above the through opening 321 inside the tubular body 32 and a fine slot 323 is set inside the inner flange 322.

The one-way valve 4 includes spool 41, valve support 42 and one-way valve spring 43. The support 42 is fixed inside the tubular body 32 of the upper piston 3. The spool 41 is set inside the support 42. A seal component 44 is set at the bottom of the spool 41 while the two ends of the spring 43 are linked onto the support 42 and the spool 41 respectively.

The self-lock piston 5 is set in the tubular body 32 of the upper piston 3. A support 51, which can be fixed on the tubular body 32, is set at the bottom of the tubular body 32. A through opening 511 is set on the support 51. A shaft 52 is located above the piston 5 while a seal component 53 is linked around it. In addition, two absorption magnetic elements 54 and 55 are respectively set at the bottom of the piston 5 and at the top of the support 51.

A seal component B2 is set around the lower cylinder sleeve 6, while a layer baffle 61 is located inside the sleeve. The baffle 61 has at least one on-way valve 62, while an opening 63 is set on the baffle 61.

A seal component E2 is set around the lower piston 7. A slide bar 71 is set above the piston 7 as the bar goes through the opening 63 on the baffle 61 while a seal component E4 is set between them. The slide bar 71 includes refill slot 711, partial flush slot 712 and full flush slot 713. The radiuses of both the refill slot 711 and the full flush slot 713 are comparatively smaller then the half flush slot 712. An adjustable bolt 714 is set at the top of the bar 71. A protrusion 73 is located at the bottom of the slot 72. Two seal components B3 and E5 are set at the top and the bottom of the protrusion 73 respectively.

The refill device 8 is set in and under the protrusion 73 of the piston 7, where it is hollow inside the protrusion 73. A radial hole 731 is located on the side wall of protrusion 73. The refill device 8 includes an adjustable support 81 and an adjusted bar 82. The support 81 is cylinder and set inside the protrusion 73 having an opening 811 opposite to the radial hole 731 of the protrusion 73. The adjusted bar 82 is set in the support 81 and a filler plug 821 is set in therewith, and blocks the hole 811 while connecting with the axis hole of the support 81.

While assembling, please refer to FIG. 9, set the piston 5 into the tubular body 32 of the piston 3 from the bottom, fix the support 51 on it, and make the shaft 51 go through the support 511 of the support 51 outside the tubular body 32 in order to limit the tubular body 32 in the piston 5; then fix the spool 41 in the cup body 31 from the top and the opening 311 at the bottom of the cup body 31 is blocked by the seal component 44 of the spool 41 with the pushing of the spring 43; after that, set the assembled upper piston 3 in the sleeve 2 and set the reset spring D between the sleeve 2 and the cup body 31, so the piston 3 can be moved up and down in the sleeve 2. A seal top chamber E1 is set between the cup body 31 and the upper section of the sleeve2, forming an area F1 between the body 31 and the sleeve 2; then set the sleeve 6 in the piston 7 from its bottom and make the shaft 71 above it while connecting through the opening 63 of the baffle 61 in the sleeve 6. Finally, set the sleeve 2 in the body 1, and match the outlet 21 and the outlet 22 with the outlet 11 and the outlet 12 of the body 1 respectively, then fix the sleeve 6 at the bottom of the body 1, and fix protrusion 24 of the sleeve 2 in between to tighten the sleeve2. The piston 7, the sleeve 6 and the sleeve 2 form an area F2 where F2 is divided into three chambers, by the piston 5 and the baffle 61, the F21, the F22 and the F23.

After the assembly of the dual flush valve F is completed, set the opening A1 of the vessel A in the toilet tank and make the bottom of the sleeve 6 fixed the locating plate A3 inside the vessel A.

Turn the valve F by 40 degrees to connect the sockets 16 of the valve F to the opening A1 of the vessel A. After assembling the valve F, The seal component B3 of the lower piston 7 is set right upon the conic surface A5 of the vessel A. The bar 82 of the refill device 8 is extended to its maxima position by the A21 in the outlet A2 of the vessel A, matching the opening 811 to its axis hole. In addition, the inlet 13 matches to the outlet S7 of the valve S by a hose. The outlets 11 and 12 are respectively connected with the inlets C12' and C12 on the ceramic water tank.

The outlets 11, 12 and 13 described above are joined through the hose junction to achieve a quick and simple assembly. Bayonet lock is the practical method of connection.

As outlet 11 as example: two L shaped slots 111 (FIG. 8) are set inside the outlet 11, while two protrusions 171 are set in the junction 17 matching to the slots 111. There is an additional spanner 172 set in the junction 17. While assembling, connect the protrusion 171 of the junction 17 to the L-shaped slots 111 of the outlet 11, then press down and turn the junction 17 until the protrusions 171 lock with the L-shaped slot 111 of the outlet 11. Then connect the junction 17 with a hose. This method is quick and simple, which also may apply to other devices (for example, the air-in combination 5) while connecting the outlet or the inlet with the hose.

Figure 10:
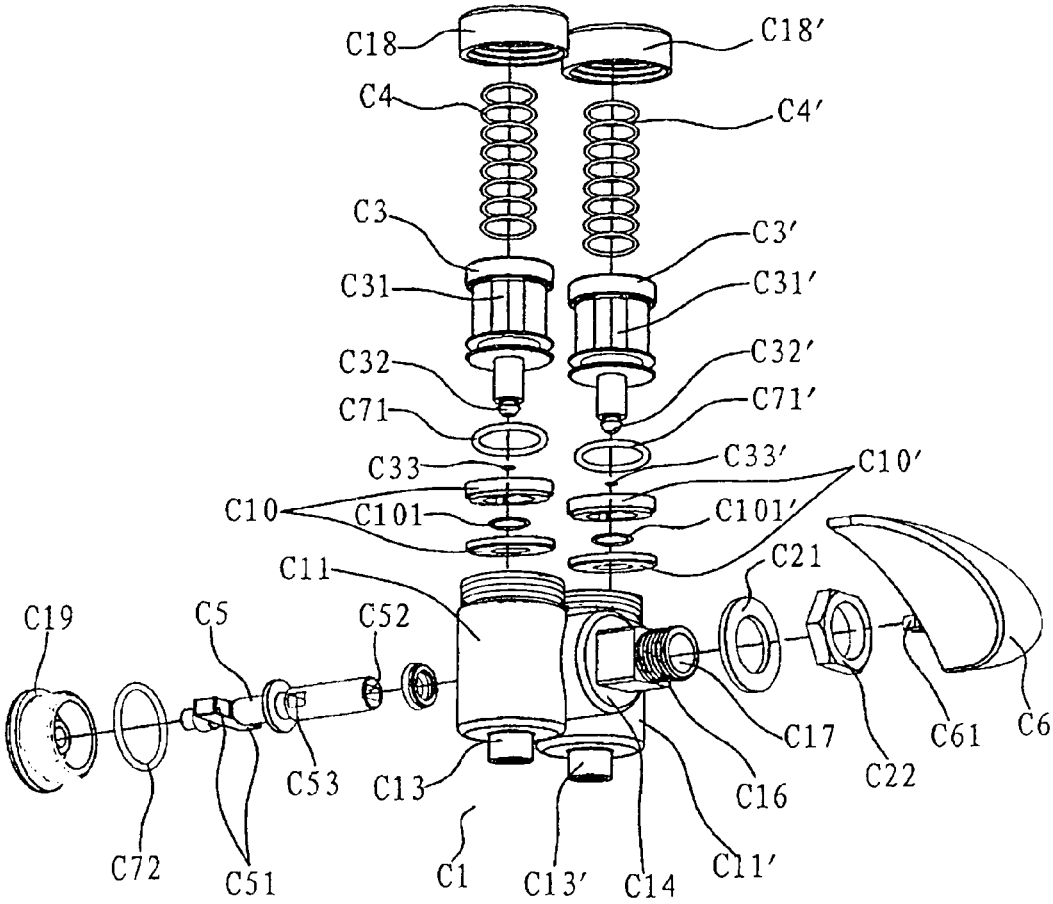
FIG. 10 is the stereoscopic decomposition diagram of the dual flush control valve
Figure 11:
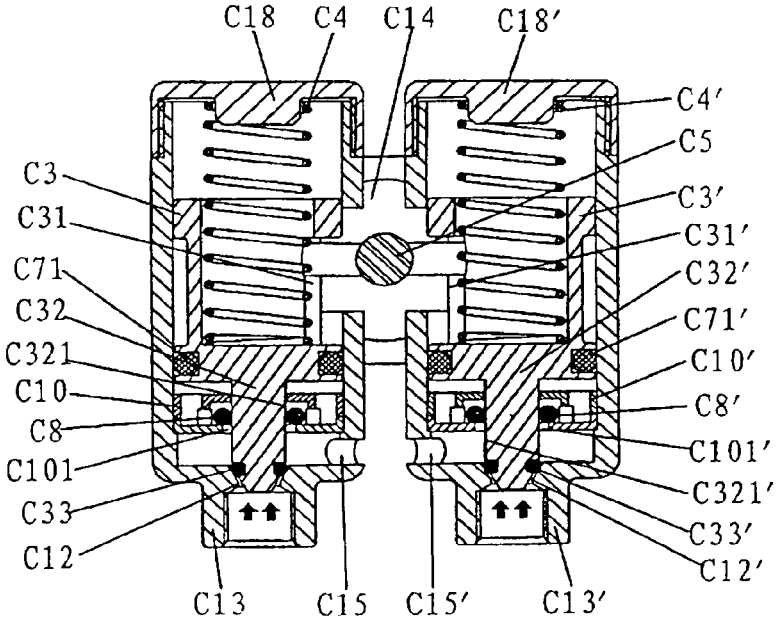
FIG. 11 is the sectional view of the dual flush open valve

The Dual Flush Control Valve C (Please Refer to FIGS. 10 and 11)

As shown in FIG. 10, the dual flush control valve C includes a body C1, having two chambers C11 and C11', two inlets C12 and C12' respectively located in the bottom of the chambers, two protrusions C13 and C13' rounded the inlets C12 and C12' having internal threads for connecting with hose junction, two covers C18 and C18' screwed at top of the chambers C11 and C11', two outlets C15 and the C15' are set at the bottom of chambers C11 and C11', a radial chamber C14 set between and through the chambers C11 and the C11', having a threaded protrusion C16 where the protrusion C16 has an opening C17 connecting to the side of the chamber C14, and a cover C19 screwed on the chamber C14 having a seal component C72 set in between.

A cylinder full flush filler plug C3 and a cylinder half flush filler plug C3' are respectively set inside the chambers C11 and C11', having openings C31 and C31' at the side of the plugs C3 and C3'. Protrusions C32 and C32' are set at the bottom of the plugs, connecting with the inlets C12 and C12' of the chambers C11 and the C11'. Seal components C33 and C33' are respectively placed at the bottom of the protrusions C32 and C32', while protrusions C71 and C71' are placed in between the plugs and the chambers. In addition, springs C4 and C4' are set in between the plugs (C3 and C3') and the covers (C18 and C18').

Baffles C10 and C10' are fixed in the chambers C11 and C11' above the outlets C15 and C15', having openings C10 and C101'. Openings C101 and C10' connect through the protrusions C32 and C32' of the plugs C3 and C3'. One-way valves C8 and C8' are covered around the protrusions C32 and C32', located inside the baffles C11 and C11'. In addition, slots C321 and C321' are set on the protrusions C32 and C32'.

The chamber C14 comprises a deflector rod C5, where the rod C5 comprises protrusion C51 matching the openings C31 and C31' of the plugs C31 and C31'. Rod C5 is designed to plug into the opening C17 of the body C1, and has square plug C52 on it. The plug C52 has a locking slot C53 at the end of the plug C52. A control handle C6 is connected in the end of the protrusion C16, having a locking hook C61 on the side.

To assemble the dual flush control valve C, refer to the FIG. 11, set the plugs C3 and C3' respectively in the chambers C11 and C11, connecting the protrusions C32 and C32' through the openings C101 and C101' of the baffle C10 and C10', then place the springs C4 and C4' on the protrusions, and screw on the covers C18 and C18'. With the plugs C3 and C3' being pushed by the springs C4 and C4', the protrusions C32 and C32' are tightly connected to the inlets C12 and C12' with seal components C33 and C331 in between. After that, insert the far end of the rod C5 into the opening C17 of the body C1, matching the protrusion C51 to the openings C31 and the C31' of the plugs C3 and C3', then screw on the cover C19 to fix the rod C5 in the chamber C14.

After the assembly completed, the dual flush control valve C can be installed on the front plate or the side plate of the ceramic water tank. The detailed method of installation is to insert the protrusion C16 through the opening of the ceramic water tank and tighten it on the ceramic water tank with pads C21 and C22. Then install the handle C6 from other side of the tank by connecting the locking hook C61 with the opening C52 of the rod C5, locking it into the slot C53 to make the rod C5 simultaneously corresponding with the handle C6. Finally connect the inlets C12 and C12' with the outlets 12 and 11 of the valve F by a hose.

Operation of the Perferred Embodiment

As shown in FIG. 2, because the pressure in the pressure water vessel A is low, the pressure water in the supply system can smoothly fill from the supply inlet M53 of the inlet valve M into the outlet M11. The pressure water fill in the duct S2 of the S through the hose, the pressure close the S32 and push aside the S52 at the same time. When the pressure water flows through the spout S8, the piston S92 would be pushed through and divides the water flow into two ways as one out of the outlet S7 and the other into the neck portion S81. When the water goes through the S81, the water forms a high speed water column and makes the chamber S41 vacuum seal around the S81 because of its smaller sectional area. With the sealed ball S62 pushed aside by the pressure, the air is allowed to flow in and out from the outlet S43. The air and water would be fully mixed in the tube A9 of the vessel A.

At the same time, the water flows through the hose from the outlet S7 then replenish into the valve F through the inlet 13. This flow of water pressure fills valve F including the chambers F1 and F2 therefore closing valve F. When the pressure in the supply system is too low (lower than 6 psi), the pressure would not be able to push the piston S92 aside, so that the pressure water would only be able to flow in the valve F from the outlet S7 closing the piston 7. Without the valve S9, when the pressure is lower than 6 psi, since the water pressure continues to fill in the inlet of the valve A and fills into the toilet tank from the outlet A4, the tank would leak.

The air-water mixture continuously fills into the water vessel A, the pressure in the water vessel A rises, so that the water's speed in the valve S drops down and so does the vacuum degree around the water column of the S8. At the same time, the pressure in the water vessel A transmits to the inlet S64 closing the sealed ball S62, but the water still continues to fill in the water vessel, until the pressure in the water vessel A is balanced with the inlet pressure while reaching the preset pressure balance.

Figure 12:
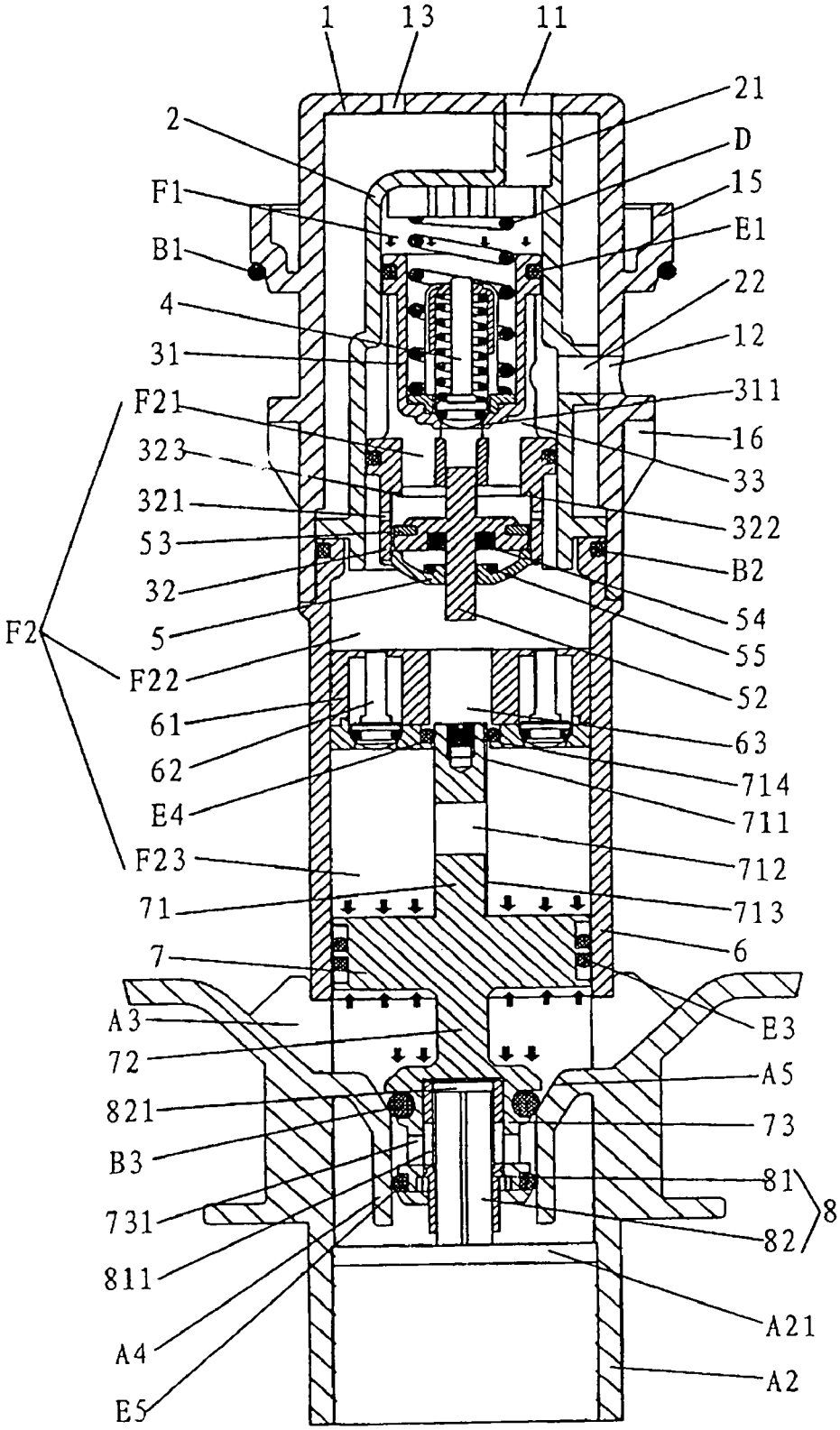
FIG. 12 is the diagrammatic sketch of the dual flush valve in the sealing state (not in function)

As shown in FIG. 12, when the pressure in the water vessel A reaches the preset pressure balance, the pressure inside and outside the valve F are in balance while the pressure level outside and inside piston 7 is also the same. Since the area inside the piston 7 is larger than the area outside, the downward pressure on the piston 7 is greater than the upward pressure, making the seal component B3 tighten (or seal) upon the A5 of the outlet A4.

While the pressure in the vessel A passes through the valve S to the outlet M11 of the valve M, the handle M21 suffers this opposite pressure, overcoming the push from the spring M22, and then pushes the valve handle onto the port, reaching the seal plate M42 of the support M41 to shut off the water inlet.

Figure 18:
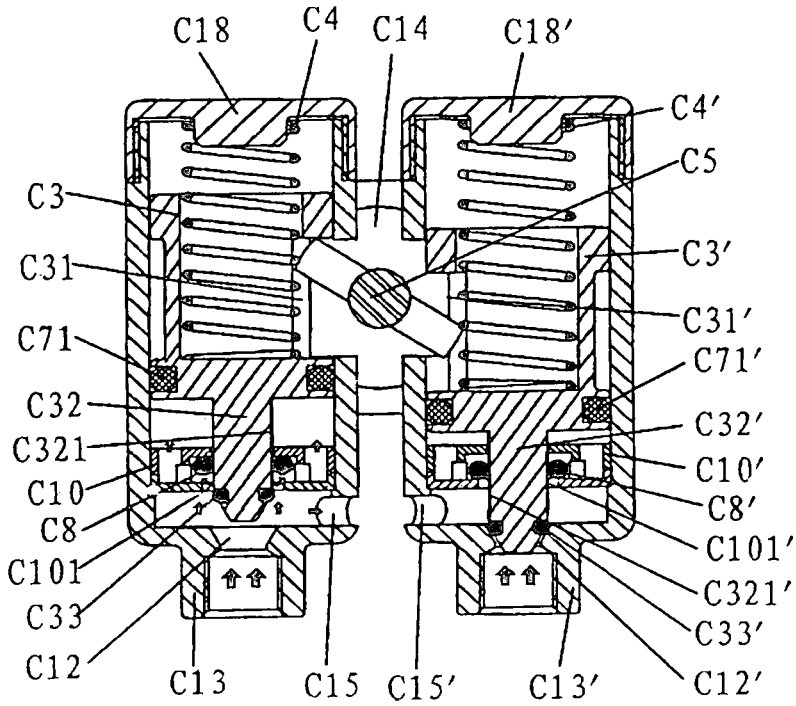
FIG. 18 is the diagrammatic sketch of the dual flush control valve under half flush opening action
Figure 19:
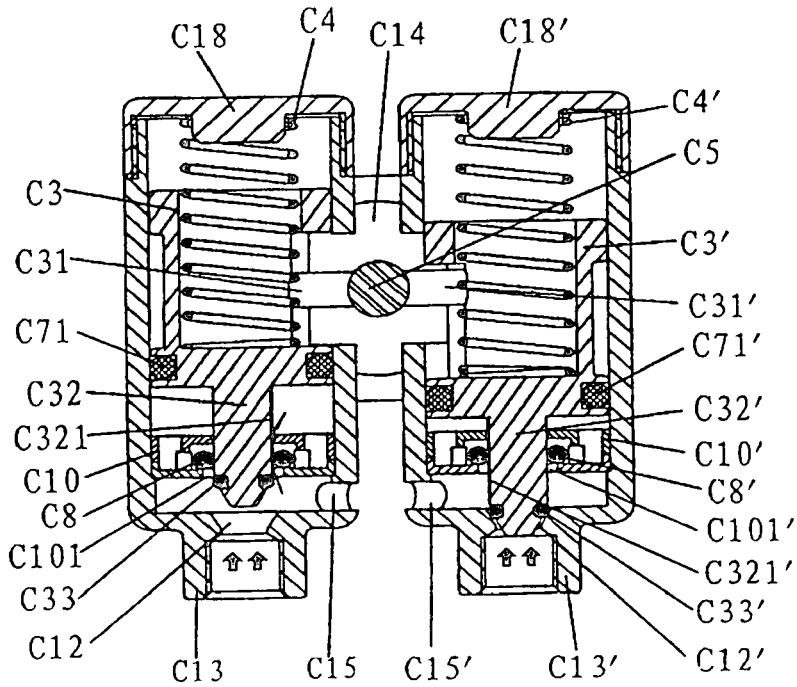
FIG. 19 is the diagrammatic sketch of the dual flush control valve

When making the partial flush also called a half flush, please refer to FIG. 18, turn the handle C6 of the valve C upward to turn the rod C5 clockwise, lift the piston C3 up, lifting the seal component C33 away from the corresponding inlet C12. Because it is connected with the outlet F12 of the valve F, the pressure water in the chamber F2 of the valve F will fill in the space under the baffle C10 of the chamber C11, and fill in the space between the pressure water vessel A and the toilet water tank, from the outlet C15. At this time, the piston C3 moves upward to form a negative pressure to open the valve C8, causing part of water fill into the chamber above the baffle C10. When the handle C6 being released, the spring C4 will push the piston C3 downward and the pressure water in the chamber above the baffle C10 will shut off the valve C8 (referred to FIG. 19). As a result, the pressure water can only fill downward along the slot C321 of the protrusion C32. Since radius of the slot C321 is so narrow, the piston C3 moves down very slowly, achieving the time delay purpose. Therefore it allows the pressure water in the valve F to be discharged completely, and avoid the possible outlet obstruct which could cause piston 7 to turn off prematurely, which would affect the total discharge volume.

Figure 13:
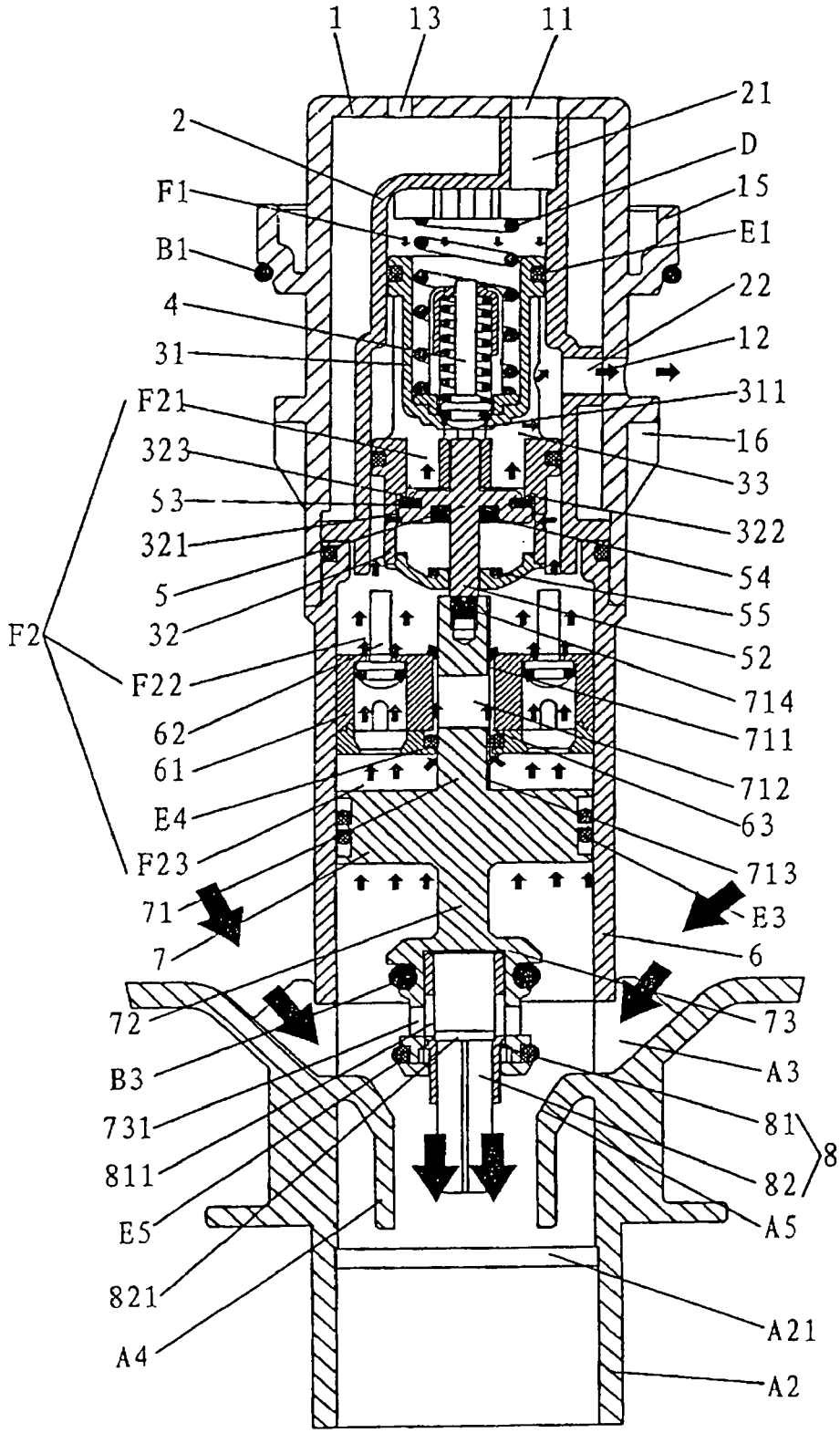
FIG. 13 is the diagrammatic sketch of the dual flush valve under half flush opening

Then refer to FIG. 13, after the pressure water in chamber F21 being discharged, the pressure in the chamber F2 drops. The pressure water in the chamber F23 will push aside the valve 62, flowing into the chamber F22 quickly, then fill toward the chamber F21 through the opening 321 in the tubular shaped body 32 of the piston 3, finally letting out from the dual flush valve. At this time, the pressure above the piston 7 drops quickly, and the water in the vessel A pushes the piston 7 upward to open the outlet A4. The pressure water in the vessel A will fill into the toilet bowl from the outlet A4 through the outlet A2. The partial flush begins at this time while the pressure in the vessel A drops at the same time.

When the piston 7 moves upward, it pushes the piston 5, moving it upward while it overcomes the attraction from of the absorption magnetic elements 54 and the 55. The seal component 53 above the piston 5 pushes upon the protrusion 322 in the tubular body 32 of the piston 3, forming a closure. Because there is still pressure in the chamber F1, the piston 3 is not able to move upward, furthermore prevents the piston 7 from moving upward. At this time, the position where piston 7 is located just makes the slot 712 of the bar 71 be located on the seal component E4 in the opening 63 in the baffle 61. In addition, because the pressure in the vessel A drops, the pressure water continuously fills into the vessel A through the valve S from the valve M, while replenishing the pressure water into valve F at the same time. The pressure water flows into the chamber between the body 1 and the sleeve 2 from the inlet 13 of the body 1, then flows into the sleeve 6 from the slot 25 in the protrusion 24 of the sleeve 2 (the piston C3 of the valve C has now shut off), to make the pressure in the F22 rise.

The pressure water will close the valve 62, therefore the water in the chamber F22 can only fill into the chamber F23 through the slot 712 in the bar 71 of the piston 7. With the large radius of the slot 712, the water can flow into the chamber F23. The piston 7 moves downward very quickly, until partial water volume in vessel A is released as shown in FIG. 14.

Figure 14:
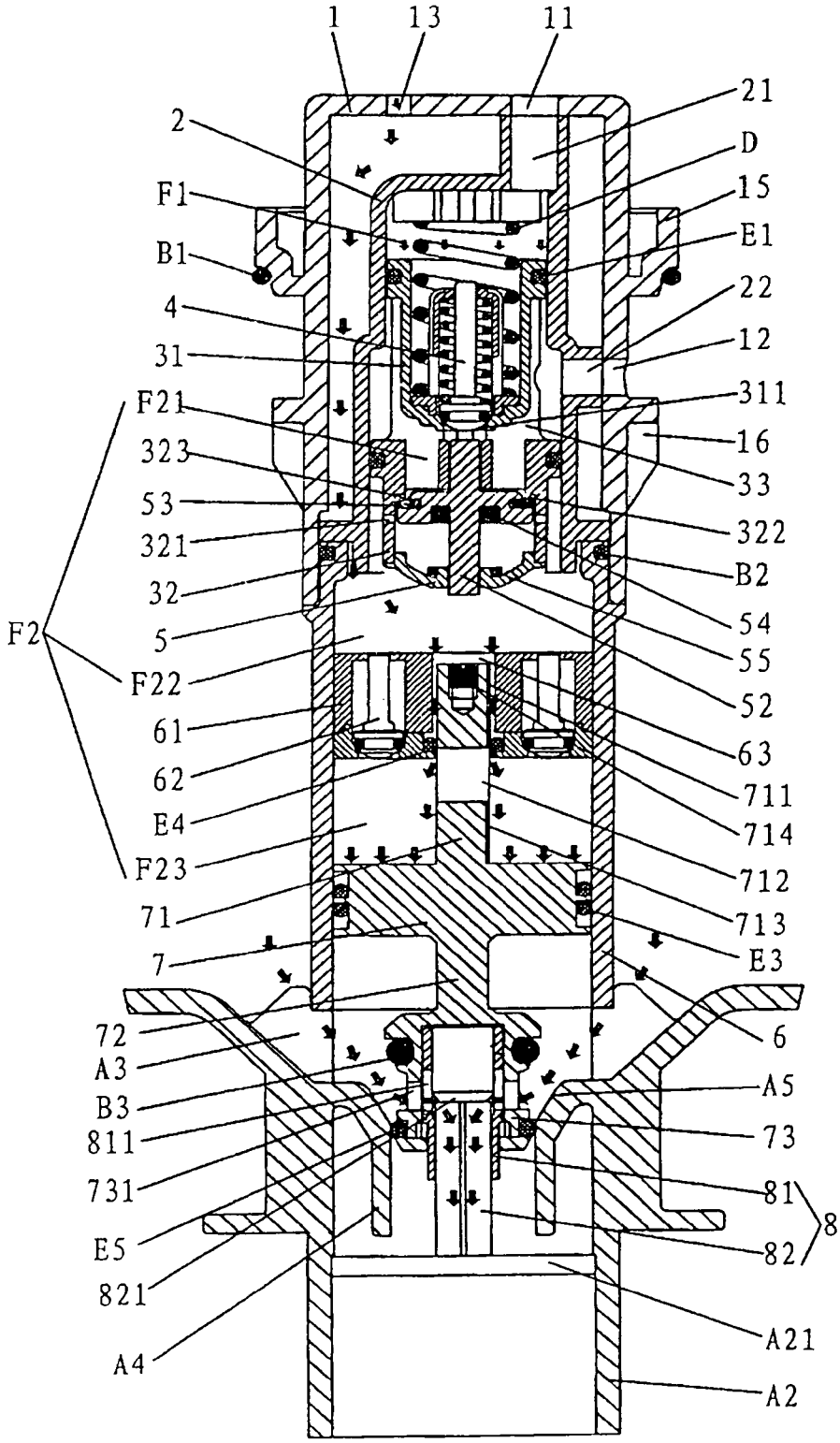
FIG. 14 is the diagrammatic sketch of the dual flush valve under half tank refilling.

In FIG. 14, the opening 63 of the baffle 61 is corresponding to the slot 711 in the bar 71 of the piston 7, and the seal component E5 under the protrusion 73 will block the outlet A4 of the vessel A. The water in the vessel A is not able to flow into the toilet bowl as the partial flush completes. When the piston 7 moves downward, the A21 in the outlet A2 will push the bar 82, connecting the opening 811 of the support 81 with its opening. When the water in the vessel A flows through the opening 731 at side of the protrusion 73 and fills into the toilet bowl from the axis hole of the support 81, the partial refill begins. The opening 63 of the baffle 61 corresponds with the slot 711 of the bar 71 and the radius of the slot 711 is very narrow, only a small amount of water is able to flow into the chamber F23 from the F22, where as the piston 7 moves downward slowly until it is closed before the full flush (As shown in the FIG. 12). The water in the A flows through the inlet device 8 into the toilet bowl in this process, forms a water tight seal.

During the above process, part of water in the chamber F22 flows through the tubular body of slot 323 in the protrusion 322 of the tubular body 32 of the piston 3 into the chamber F21 until the pressures below and above the piston S are in balance, and opens the piston S by both gravity and the magnetic element's absorptive force, forming the original closure status as shown in FIG. 12.

Figure 15:
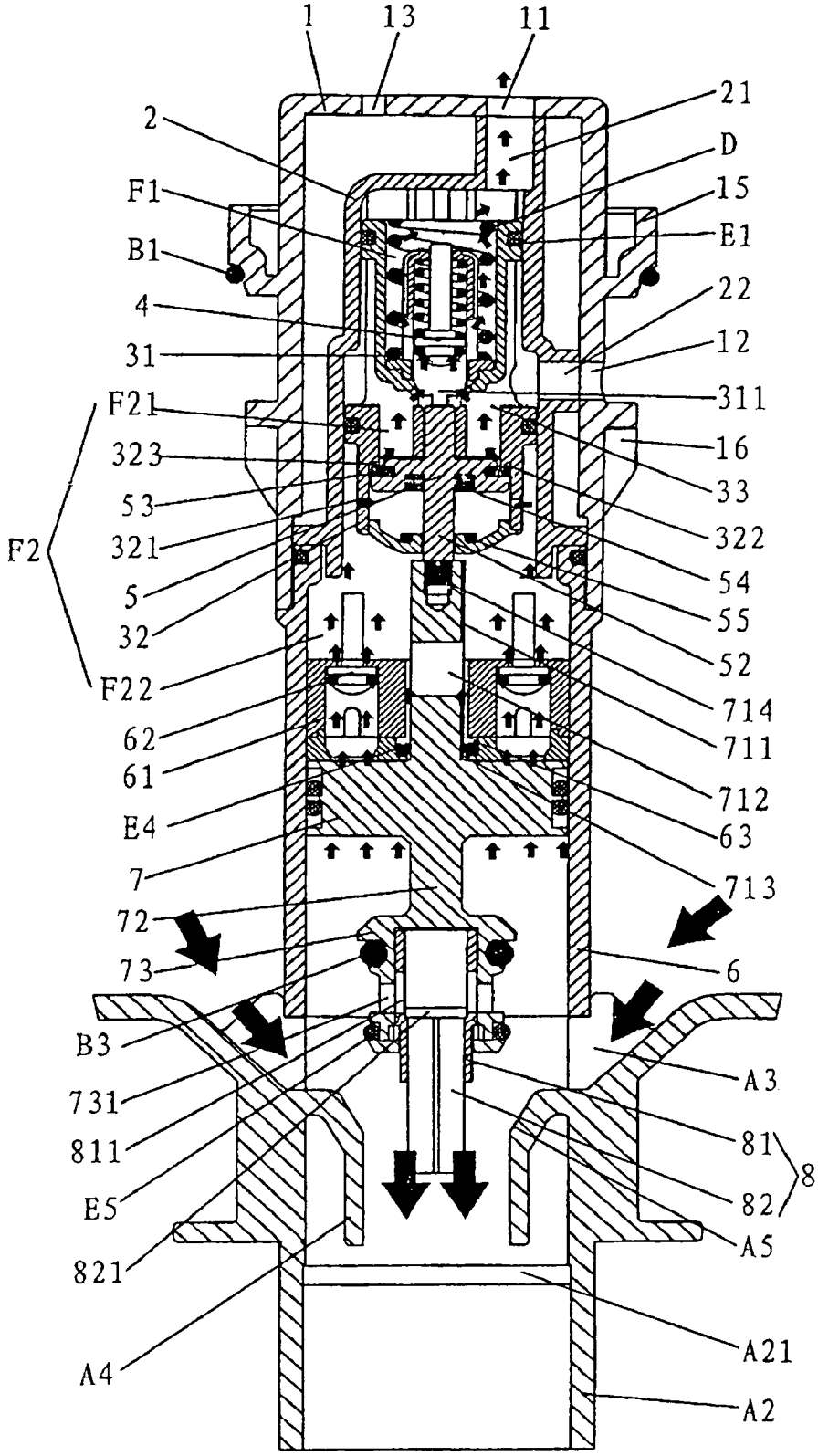
FIG. 15 is the diagrammatic sketch of the dual flush valve under full flush
Figure 16:
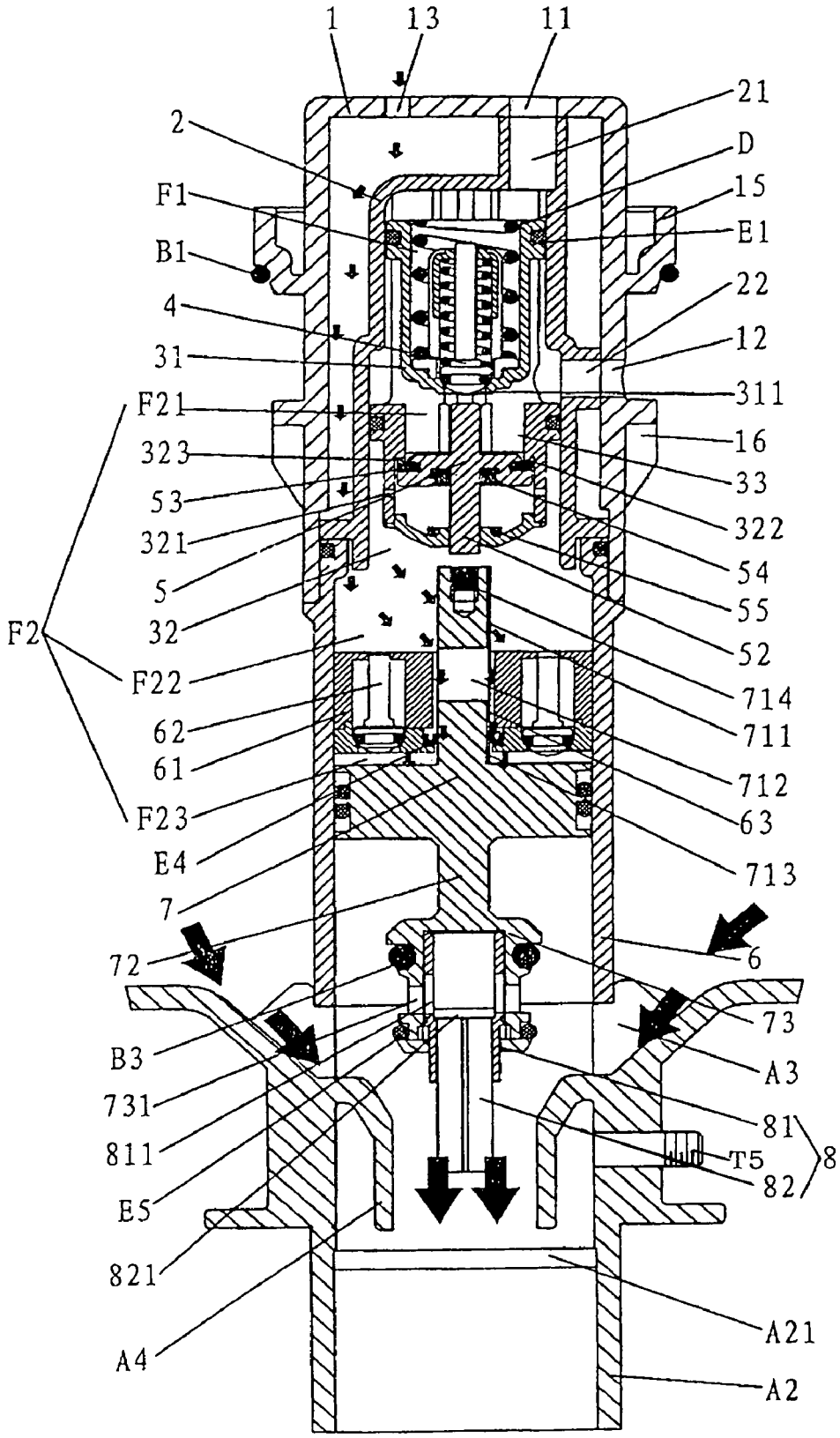
FIG. 16 is the diagrammatic sketch of the dual flush valve under full tank refilling (section one)

When the full flush is desired, push downward on the handle C6 of the valve C, making the C5 anti-clockwise to open the valve C3' (the steps here are the same as the process describe above). Because the valve is connected with the outlet 11 of the valve F, the pressure water in the chamber F1 of the valve F will be forced out from the outlet C15'. As shown in the FIG. 15, the pressure above the piston 3 (the pressure in the top chamber F1) will drop sharply, the valve 4 will be pushed open by the pressure in the chamber F2. Then the pressure water of the F2 will flow through the chamber F1 then flows out from the outlet 21, opening the outlet A4 in the vessel A, providing a full flush. The discharging process of the pressure water in the chamber F2 is the same as above. Some differences are: because both the piston 3 and the piston 7 move upward at the same time, the piston 7 rises higher then piston 3 until it reaches the preset position shown in FIG. 15. Now, the piston C5' of the valve C is closed, while water continuously fills into the valve F raising the pressure in the valve F. After the water in the valve F flows into the chamber F22, the pressure will close the valve 62, therefore the water can only flows through the slot 713 into the chamber F23 (At this time, the seal component E4 of the opening 63 in the baffle 61 matches to the slot 713 in the bar 71 of the piston 7). Because the radius of the 712 is very narrow, very little water would fill into the chamber F23, dropping the 7 very slowly. It can make the reset time of the piston 7 longer, discharging the water in the vessel A completely, whereas the full flush is completed (As shown in the FIG. 6). After the full flush is completed, the slot 713 in the bar 71 of the piston 7 still matches to the seal component E4 of the opening 63 in the baffle 61. The piston 7 still drops slowly. Now, after the water in the vessel A continuously flows into the toilet bowl and remains there, forming water tight seal, the first refill is completed.

Figure 17:
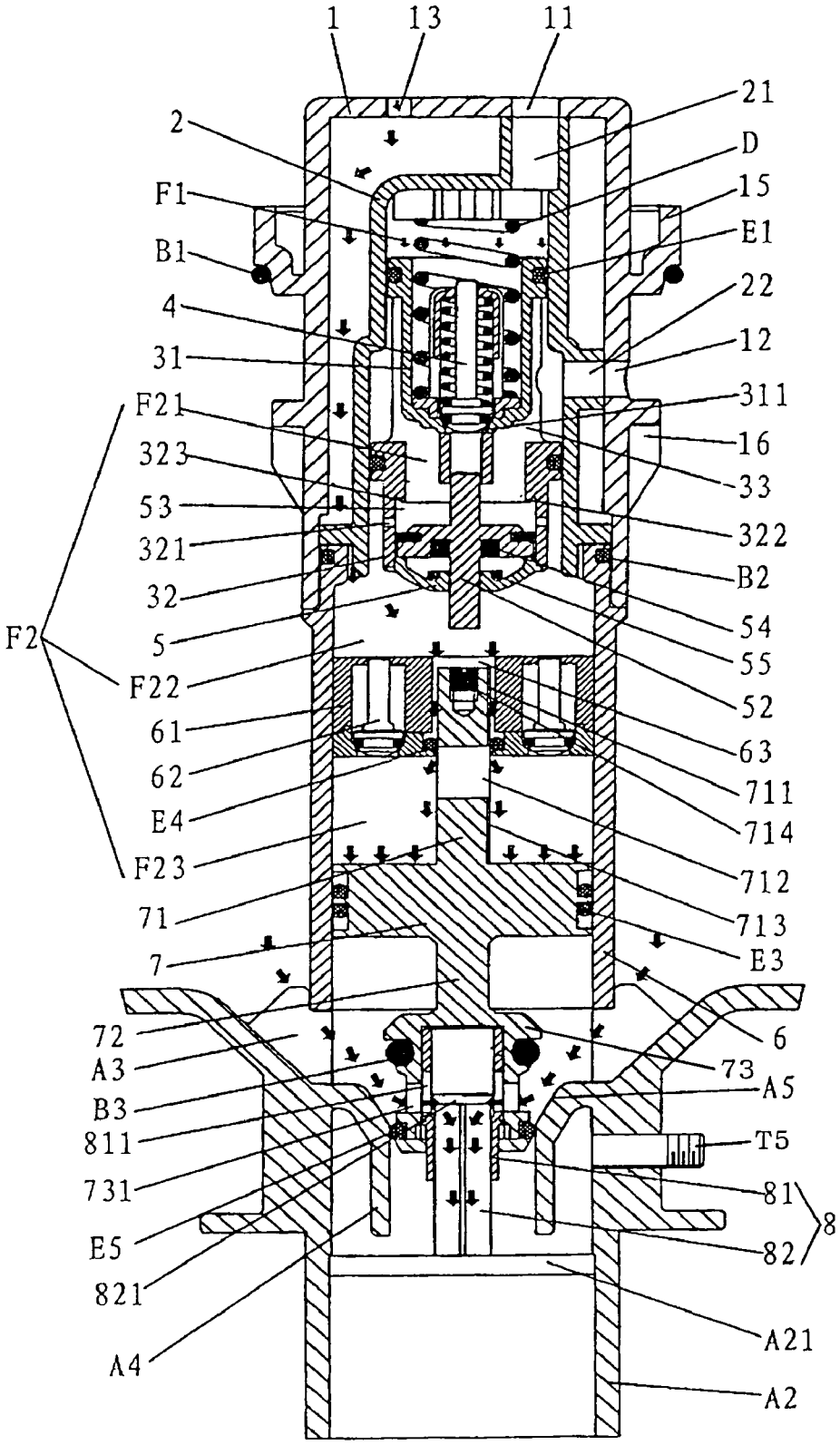
FIG. 17 is the diagrammatic sketch of the dual flush valve under full tank refilling (section two)

When the slot 713 in the bar 71 of the piston 7 is responding to the seal component E4 of the opening 63 in the baffle 61, the piston 7 will move downward quickly to the position shown in FIG. 17, meaning the seal component E5 under the protrusion 73 of the piston 7 blocks off the outlet A4, as the second refill begins. The process is the same as the partial flush described herein.

While the first refill and the second refill, the self-locking piston 5 opens, when open process is the same as the process in the partial refill.

Additionally, the stabilizing outlet A6 is set at side of outlet A2 in the vessel A in the present invention, which is used to discharge the stabilizing water between the A and the ceramic water toilet tank. Because the flush cover A61 and the flush baffle A62 are screwed on the stabilizing outlet A6, when the pressure water vessel discharges, the baffle A62 is tightened upon the cover A61 under the water pressure, the pressure water won't be discharged. After the full flush is over, the stabilizing inlet water would push aside the cover A62 and flows into the toilet bowl.

Triple Safeguard

Additionally, the pressure water vessel A works in a sealed status, it would be dangerous if the pressure is allowed to get too high, so as the pressure is limited within a preset range. The invention comprises a triple safeguard:

1. The Infill Valve M

Figure 20:
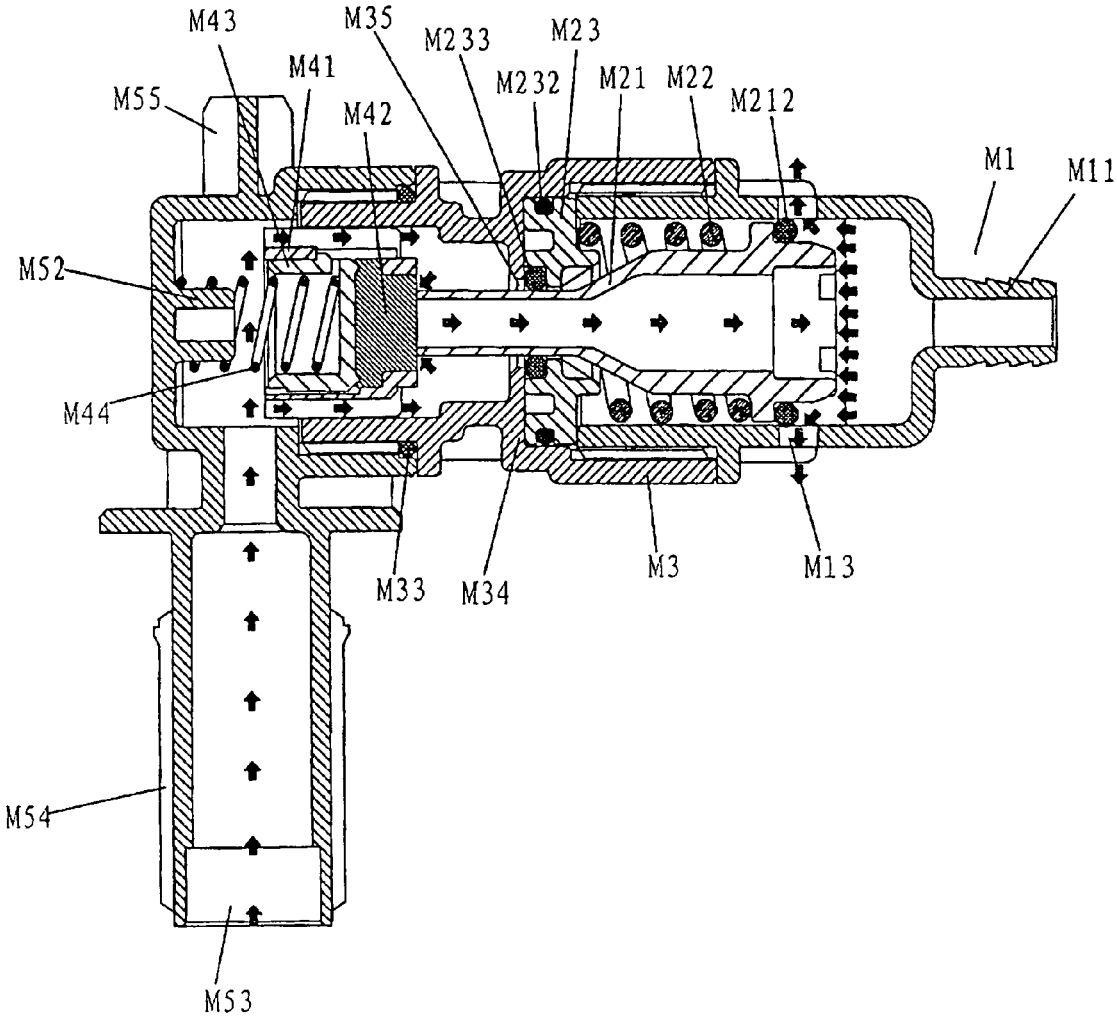
FIG. 20 is the diagrammatic sketch of the infill stabilizing valve under pressure discharging

Please refer to FIG. 20. If a blockage makes M unable to complete the water's filling (for example, a blockage between the M21 and the M42), the pressure in the vessel A will continue rising, causing the increasing inverse pressure of the valve handle M21 to overcome the push of the spring M44 in the support M41 until it reaches the preset pressure limit. Then the protrusion M211 of the handle M21 will move downward to the outlet M13 in the cover M1 to open the cover M13. Then the water in the A will flow out from the outlet M13 until the pressure drop to the preset working pressure, then the water will be rerouted and flows into the baffle between the vessel A and the ceramic toilet water tank, then the water will flow directly into the toilet bowl from the outlet A6.

2. The Double Safeguard of the Dual Flush Control Valve C.

The pistons C3 and C3' of the valve C are connected to the water pressure in the valve F, and the pressure inside of the valve F is equal to the pressure inside the vessel A. Therefore, when the pressure in the vessel A reaches a certain level, the water pressure in the valve F will push the protrusions C32 and C32' of the pistons C3 and C3' to push them away from the seal surface causing them to open, so that the valve F begins the full flush or the partial flush to achieve the discharging protection. The control valve C has two filler plugs, C3 and C3', if one of the two is out of work, the other is provided as back up and an additional safeguard.

The third safeguard is: if the pressure in the vessel A is for whatever higher than the working pressure, the valve M begins discharging protection; when the valve M is not working or other factors allow the pressure in the vessel A continue to rise, the C3 or C3' of the piston C will cause the partial flush or the full flush valve of the system and allow the pressure to be discharged completely to provide additional protection.

Although there has been hereinabove described a specific pressurized dual flush system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

CALL OUT LIST OF ELEMENTS

Pressure Water Vessel A
Opening A1
Outlet A2
Locating Plate A3
Outlet A4
Conic Surface A5
Stabilizing Outlet A6
Flush Gland A61
Flush Baffle A62
Stabilizing Outlet A6
Cylinder Locating Hole A7
Inlet A8
Air and Water Mixed Duct A9

Infill Valve M
Front Cover M1
Valve Handle Parts M2
Valve Body M3
Valve Support M4
Rear Cover M5
The Outlet M11
Out Gate M13
Valve Handle M21
Valve Handle spring M22
Seal Cover M23
Flange M211
Seal Component M212
Opening M231
Seal Component
Internal Thread M31
External Thread M32
Seal Component M33
Baffle M34
Pole M35
Movable Valve Support M41
Sealing Plate M42
Hold Set M43
Valve Support Spring M44
Internal Thread M51
Fixing Pole M52
Inlet M53
External Thread M54
Cross Guide Pole M55

Air-in Valve S
Body S1
Air-in Valve S
Infill Duct S2
Anti-Siphon Valve S3
Discharge Duct S4
Check Valve S5
Air-in Valve S6
Outlet S7
Low Pressure Control Valve S9
Hose Junction S21
Infill Duct S2
Seal Component S22
Duct S31
Sealed Siphon Ball S32
Cover S33
Air Hole S34
Seal Components S35
Outlet S43
Duct S4
Fixed Disk S11
Air Spout S8
Neck Portion S81
Ring Chamber S41
Seal Component S82
Valve Cover S42
Control Valve S5
Valve Support S91
Filler Plug S92
Spring S93
Seal Component S44
Filler A92
Seal Component S95
Channel S51
Sealed Ball S52
Air-in Valve S6
Channel S61
Sealed Ball S62
Cover S63
Inlet S64
Seal Component S65
Outlet S7
Spout S8

Dual Flush Valve F
Valve Body 1
Upper Cylinder Sleeve 2
Upper Piston 3
One-Way Valve 4
Self-Lock Piston 5
Lower Cylinder Sleeve 6
Lower Piston 7
Refill Device 8
Protrusion 15
Seal Component B1
Distribution Sockets 16
Full Flush Outlet 11,
Half Flush Outlet 12

Inlet 13
Full Flush Outlet 21
Half Outlet 22
Ring Locating Protrusion 24
Depression 25
Cup Body 31
Seal Components E1
Opening 311
Tubular Body 32
Connecting Rib 33,
Seal Component E2
Opening 321
Inner Flange 322
Fine Slot 323
One-Way Valve 4
Spool 41
Valve Support 42
One-Way Valve Spring 43
Support 42
Seal Component 44
Self-Lock Piston 5
Support 51,
Opening 511
Shaft 52
Seal Component 53
Absorption Magnetic Element 54
Absorption Magnetic Element 55
Seal Component B2
Layer Baffle 61
One-Way Valve 62
Opening 63
Seal Component E2
Slide Bar 71
Seal Component E4
Refill Slot 711
Half Flush Slot 712
Full Flush Slot 713
Adjustable Bolt 714
Protrusion 73
Seal Components B3 and E5
Refill Device 8
Radial Hole 731
Adjustable Support 81
Adjusted Bar 82
Opening 811
Filler Plug 821

Dual Flush Control Valve C
Body C1
Chambers C11 and C11'
Inlets C12 and the C12'
Protrusions C13 and C13'
Covers C18 and C18'
Outlets C15 and C15'
Radial chamber C14
Threaded protrusion C16
Opening C17
Cover C19
Seal component C72
Cylinder Full Flush Filler Plug C3
Cylinder Half Flush Filler Plug C3'
Openings C31 and C31'
Protrusions C32 and C32'
Inlets C12 and C12'
Seal Components C33 and C33'
Protrusions C71 and C71'
Springs C4 and C4'
Baffles C10 and C10'
Openings C101 and C101'
One-Way Valves C8 and C8'
Slots C321 and C321'
Deflector rod C5
Protrusion C51
Square Plug C52
Locking Slot C53
Control Handle C6
Locking Hook C61

The invention claimed is:

1. A pressure assisted dual flush operating system comprising:

a vessel for receiving, containing and discharging pressurized water, said vessel having an outlet for discharge of water from said vessel;

an anti-siphon valve having an air inlet for introducing water into said vessel;

an inlet valve for admitting water to said anti-siphon valve;

a dual flush valve for selectively releasing different quantities of water from said vessel through the vessel outlet; and a control valve for selecting one of the different quantities of water released by said dual flush valve.

2. The system according to claim 1 wherein said vessel is sized for containment within a toilet tank and said control valve is disposed in fluid communication with said dual flush valve through flexible conduits to enable placement of said control valve anywhere on said toilet tank.

3. The system according to claim 1 wherein said control valve includes a pivotable handle and two conduits interconnected with said dual flush valve and a mechanism for hydraulically selecting one quantity of water to be released by said dual flush valve upon pivoting said handle in one direction and hydraulically selecting another quantity of water to be released by said dual flush valve upon pivoting in an opposite direction.

4. The system according to claim 3 wherein the selection of water to be released by pivoting of said handle is reversed upon reversal of interconnection of the two conduits between said control valve and said dual flush valve.

5. The system according to claim 1 wherein said dual flush valve is disposed within said vessel.

6. The system according to claim 2 wherein said dual flush valve is disposed within said vessel and said anti-siphon valve and inlet valve are attached to said vessel.

7. The system according to claim 6 wherein said inlet valve and said siphon valve are in fluid communication with one another through a conduit disposed exterior to said vessel.

8. The system according to claim 7 further comprising a fluidic connection between said control valve, said inlet valve and the vessel outlet for directing overflow water into said vessel outlet to reduce water accumulation in said toilet tank beneath said vessel.

9. The system according to claim 7 wherein said dual flush valve includes a gland for removing water from between said vessel and said toilet tank upon release of water through said vessel outlet.

10. The system according to claim 7 wherein said anti-siphon valve includes a valve for providing back flow protection to the inlet valve in order to prevent contaminated water from being pulled back into the inlet valve and a water supply connected thereto.

* * * * *